US006097411A

United States Patent [19]

Maeoka et al.

[11] Patent Number: 6,097,411

[45] **Date of Patent: *Aug. 1, 2000**

[54] INK JET APPARATUS, INK JET CARTRIDGE AND INK JET HEAD HAVING A CONSTRUCTION WHICH IMPROVES INK JET HEAD INTEGRITY

[75] Inventors: Kunihiko Maeoka; Kazuaki Masuda, both of Kawasaki; Tsutomu Abe, Isehara, all of Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/232,585

[22] Filed: Apr. 25, 1994

Related U.S. Application Data

[63] Continuation of application No. 07/822,218, Jan. 17, 1992, abandoned.

[30] Foreign Application Priority Data

Jan. 18, 1991 [JP] Japan ..... 3-004706
Jan. 18, 1991 [JP] Japan ..... 3-004709

[51] Int. Cl.[7] ..... B41J 2/14

[52] U.S. Cl. ..... 347/63

[58] Field of Search ..... 347/56, 63, 65, 347/67, 94, 20

[56] References Cited

U.S. PATENT DOCUMENTS

| | | | |
|---|---|---|---|
| 4,313,124 | 1/1982 | Hara | 347/57 |
| 4,345,262 | 8/1982 | Shirato et al. | 347/10 |
| 4,459,600 | 7/1984 | Sato et al. | 347/47 |
| 4,463,359 | 7/1984 | Ayata et al. | 347/56 |
| 4,558,333 | 12/1985 | Sugitani et al. | 347/65 |
| 4,723,129 | 2/1988 | Endo et al. | 347/56 |
| 4,740,796 | 4/1988 | Endo et al. | 347/56 |
| 4,847,636 | 7/1989 | Durbeck et al. | 347/67 |
| 5,148,192 | 9/1992 | Izumida et al. | 347/56 |
| 5,485,184 | 1/1996 | Nakagomi et al. | 347/63 |

FOREIGN PATENT DOCUMENTS

| | | |
|---|---|---|
| 54-056847 | 5/1979 | Japan . |
| 59-123670 | 7/1984 | Japan . |
| 59-138461 | 8/1984 | Japan . |
| 60-071260 | 4/1985 | Japan . |

*Primary Examiner*—David F. Yockey
*Assistant Examiner*—Michael Nghiem
*Attorney, Agent, or Firm*—Fitzpatrick, Cella, Harper & Scinto

[57] ABSTRACT

An ink jet recording head is provided with a plurality of ink pathways and a plurality of ejection outlets in communication with the ink pathways. The ink jet recording head includes (a) a support member provided with a plurality of energy generating elements capable of generating energy to be utilized for ejecting ink through the ejection outlets, the energy generating elements being disposed in accordance with the ejection outlets; (b) a grooved top plate provided with a plurality of grooves to establish the ink pathways in accordance with the energy generating elements of the support member; and (c) a protruded member which is protruded above the surface of the grooved top plate. An ink cartridge includes the ink jet recording head and an ink container. An ink jet recording apparatus includes a control mechanism and the ink cartridge.

6 Claims, 8 Drawing Sheets

INK JET APPARATUS, INK JET CARTRIDGE AND INK JET HEAD HAVING A CONSTRUCTION WHICH IMPROVES INK JET HEAD INTEGRITY

This application is a continuation of application Ser. No. 07/822,218 filed Jan. 17, 1992, now abandoned.

FIELD OF THE INVENTION

The present invention relates to an improved ink jet recording head for use in an ink jet recording system and also to an ink jet recording apparatus provided with said ink recording head. More particularly, the present invention relates to an ink jet recording head which is improved to be free of not only crosstalk but also the inflow of an adhesive and also to an ink jet recording apparatus provided with said ink jet recording head.

RELATED BACKGROUND ART

There have been proposed a variety of liquid jet recording systems (bubble jet recording systems in other words). Among such liquid jet recording systems, the public attention has been focused on those liquid jet recording systems disclosed, for example, in U.S. Pat. Nos. 4,723,129 and 4,740,796 in recent years. Such liquid jet recording systems are of the type that a recording liquid (typically, ink) is discharged utilizing thermal energy and recording is performed with the recording liquid (ink) discharged. There are advantages for these liquid jet recording systems that recording of a high quality image with a high density and a high resolution can be performed at a high speed and it is easy to attain color recording and miniaturization. A typical embodiment of the recording apparatus in which such liquid jet recording system is employed comprises an ejection outlet for ejecting recording liquid (ink), a liquid pathway in communication with said ejection outlet and having, as part of its constituent, a heat acting portion at which thermal energy, which is utilized for ejecting the liquid (ink) from the ejection outlet, is effected to the liquid, and an electrothermal converting body which is disposed to correspond to the liquid pathway and which serves to generate the thermal energy to be utilized for ejecting the liquid (ink).

As for the constitution of the recording head to be used in such liquid jet recording system as above described, there are known two types in general classification; a first type having ink pathways in communication with a common liquid chamber which comprises a base member provided with heat generating elements, partition walls made of a photosensitive resin and a top plate, and a second type having ink pathways in communication with a common liquid chamber, formed by providing a member to be a top plate provided with grooves to provide the ink pathways and the common liquid chamber which were formed by means of etching technique and a base member provided with heat generating elements and laminating the former on the latter to establish the ink pathway and the common liquid chamber.

There is known a head cartridge having the configuration of the above-mentioned second type in which the ink jet head is connected to an ink supply tank. Specifically, an example of such head cartridge is of the constitution shown in FIGS. 1 and 2. The head cartridge shown in FIGS. 1 and 2 is detachably set to a recording apparatus. The ink jet recording head in this case further comprises an ejection board provided with ink ejection outlets which is integrated to the foregoing grooved member by means of injection molding technique.

FIG. 1 is a schematic exploded view of the head cartridge. In FIG. 1, "IJU" stands for a unit of the system for generating thermal energy depending upon a electric signal applied to cause film boiling at ink, thereby ejecting ink. Reference numeral 100 stands for a heater board comprising a plurality of electrothermal converting bodies serving to generate said thermal energy which are linearly arranged on a Si base member and electric wiring made of Al, etc. serving to supply electric power to the electrothermal converting bodies. Reference numeral 200 stands for a wiring board containing wirings corresponding to the wirings of the heater board 100 and a plurality of pads 201 situated at the portion behind said wirings and which serve to receive electric signals from the main body of the apparatus. Reference numeral 1300 stands for a top plate provided with partition walls constituting ink pathways corresponding to ink ejection outlets and a common liquid chamber. The top plate 1300 is integrally provided with a socket 1500 and an orifice plate 400. The socket 1500 serves to receive ink supplied from an ink container and introduce the ink into the common ink chamber. The orifice plate 400 is provided with a plurality of ejection outlets. The partition walls disposed at the top plate 1300 are integrally formed with the top plate using an appropriate resin material such as polysulfone.

Reference numeral 300 stands for a support member made of a metal for example. The support member 300 is a structural constituent of the recording head unit and it serves to support the wiring board 200 through the rear face thereof. Reference numeral 500 stands for a pressure bar plate spring in the M-like form. The pressure bar plate spring 500 serves to press the portion of the top plate 1300 corresponding to the common liquid chamber by the central portion thereof while pressing the portion of the top plate 1300 corresponding to the ink pathways through the linear contact by a drooped portion 501 of the pressure bar plate spring. The pressure bar plate spring 500 has leg portions which are contacted to the rear face of the support member 300 while penetrating through openings 3121 of the support member, wherein the heater board 100 and the top plate 1300 are made such that they are pinched between the support member 300 and the pressure bar plate spring 500. Thus, the heater board 100 and the top plate 1300 are secured to be pressure contacted to the support member 300 by way of an urging force caused by the pressure bar plate spring 500 and the drooped portion 501. The support member 300 contains a pair of positioning openings 312 corresponding to a pair of positioning protrusions 1012 mounted at the ink container and another pair of positioning openings 1900 corresponding to a pair of positioning and thermally fuse-fixing protrusions 1800 mounted also at the ink container. At the rear face of the support member 300, there are disposed a pair of positioning protrusions 2500 and 2600 for the positioning relative to the carriage on the side of the main apparatus body. The support member 300 further contains an opening 320 which permits an ink supply pipe serving to supply ink from the ink container to penetrate therethrough. The wiring board 200 is fixed to the support member 300 by means of an adhesive or the like.

The support member 300 is provided with a pair of recessions 2400 respectively positioned near the positioning protrusion 2500 or 2600. And, as shown in FIG. 2, the assembled head cartridge IJC has a head projected portion having three sides provided with a plurality of parallel and continuous grooves 3000 and 3001. The recessions 2400 are located at extensions of the grooves at the top and bottom sides to prevent the ink or foreign matters such as dust moving along the grooves from reaching the positioning protrusions 2500 and 2600. Reference numeral 800 stands for a covering member provided with the parallel grooves 3000. The covering member 800 constitutes an outer casing of the head cartridge IJC and cooperates with the ink container to define a space for accommodating the recording head unit IJU. Reference numeral 600 stands for a ink supply passage member provided with the parallel grooves 3001. The ink supply passage member 600 has an ink conduit 1600 in communication with an ink supply pipe 2200 and cantilevered on the side of the ink supply pipe 2200. In order to assure the capillary action with the ink supply pipe 2200 at the fixed portion with the ink conduit 1600, a sealing pin 602 is provided.

Reference numeral 601 stands for a gasket to seal the connecting portion between the ink container and the ink supply pipe 2200. Numeral reference 700 stands for a filter disposed at the container side end of the ink supply pipe 2200. The ink supply passage member is molded, and therefore, it is produced at a reduced cost with a high positional accuracy. In addition, the cantilevered structure of the ink conduit 1600 assures the press-contact between the ink conduit 1600 and ink inlet 1500 of the top plate 1300 even if the ink supply passage member 600 is mass-produced. In this embodiment, a sealing bonding agent is flown from the side of the ink supply passage member under the press-contact state.

The ink supply passage member 600 may be easily fixed to the support member 300 by inserting and penetrating backside pins (not shown) of the ink supply passage member 600 through openings 1901 and 1902 of the support member 300 and by heat-fusing the portion where the pins are projected through the backside of the support member 300. The slight projected portions in this case are accommodated in recessions (not shown) in the recording head unit IJU mounting side face of the ink container and therefore, the unit IJU can be correctly positioned.

The ink container comprises a cartridge main body 1000, an ink absorbing material 900 and a cover member 1100. The ink absorbing material 900 is inserted into the cartridge main body 1000 from the side opposite from the unit IJU mounting side and thereafter, the cover member 1100 seals the cartridge main body. The ink absorbing material 900 is thus disposed in the cartridge main body 1000. Reference numeral 1200 stands for an ink supply port which serves to supply ink to the unit IJU comprising the foregoing parts 100–600. It also serves as an ink injection inlet to permit initial ink supply to the absorbing material 900 before the unit IJU is mounted to the portion 1010 of the cartridge main body 1000.

In this embodiment, the portions through which ink can be injected into the ink container are air vent port 1401 and the ink supply port 1200. There are disposed ribs 2300 on the inside face of the cartridge main body and other ribs 2500 and 2501 on the inside face of the cover member 1100. These ribs are effective to provide within the ink container an air existing region extending continuously from the side of the air vent port 1401 to the corner portion of the cartridge main body which is most remote from the ink supply port 1200. By this, a good supply of ink from the ink absorbing material is ensured. Therefore, in order to perform relatively good and uniform injection of the ink, it is important to supply the ink through the ink supply port 1200. This ink supply method is practically effective. The number of the ribs 2300 in this embodiment is four (in FIG. 1, the two ribs on the upper face are shown). The ribs 2300 extend parallel to a movement direction of the carriage adjacent to the rear side of the cartridge main body 1000, by which the absorbing material is prevented from being closely contacted to the inner surface of the rear side of the cartridge main body 1000. The ribs 2301 and 2302 are disposed on the inside face of the cover member 1100 at an extended position in the direction of an extension of the ribs 2300, however, as contrasted to the ribs 2300, they are designed to be divided ribs. By this, the air existing space is made larger than the former. The ribs 2301 and 2302 are distributed on the entire area of the cover member 1100, and the area thereof is not more than one half of the total area. By these ribs, the ink in the corner region of the ink absorbing material 900 which is most remote from the ink supply port 1200 can be stably and assuredly supplied to the side of the ink supply port by capillary action. Reference numeral 1401 stands for an air vent port disposed at the cover member for communication between the inside of the ink container with the outside air. Reference numeral 1400 stands for a water repellent material arranged in the inside of the air vent port 1401. The water repellent material 1400 serves to prevent the ink from leaking outside through the air vent port 1400.

The ink accommodating space of the ink container is in a substantially rectangular form, and the long side thereof faces in the direction of carriage movement, and therefore, the foregoing rib arrangements are particularly effective. When the long side extends along the movement direction of the carriage, or when the ink accommodating space is in the form of a cube, the ribs are desirably disposed on the entire surface of the cover member 1100 to thereby stabilize the ink supply from the ink absorbing member 900.

The ink container is covered by the cover member 800 after the unit IJU is mounted thereto. Then, the unit IJU is enclosed therearound except for the bottom thereof. However, the head cartridge is mounted to the carriage on the side of the main body, where the bottom opening thereof comes close to the carriage to thereby form a space substantially enclosed on all sides. Because of this, the heat generation from the recording head IJH in the enclosed space distributes uniformly within the enclosed space to maintain the temperature of the enclosed space at a uniform value. However, there is an occasion that the temperature slightly increases when the recording head IJH is continuously operated over a long period of time. In order to avoid occurrence of such temperature rise, there is disposed a slit 1700 having a width smaller than the enclosed space, by which the spontaneous heat radiation is enhanced to prevent the temperature rise, while the uniform temperature distribution of the entire of the unit IJU is not influenced by the ambient conditions.

After being assembled as the head cartridge IJC as shown in FIG. 2, ink is supplied from the ink supply port 1200 of the ink container to the ink conduit 1600 in the ink supply passage member 600 through the opening 320 of the support member 300 and a supply pipe 2200 arranged while penetrating through an inlet disposed at the rear side of the chamber of the ink supply passage member 600. After passing therein, the ink is supplied to the common chamber through the ink inlet port 1500 of the top plate 1300. The connecting portions of the supply pipe and the conduit are provided with a packing of silicon rubber, butyl rubber or the like to hermetically seal them, whereby the ink supply passage is assured.

In this embodiment, the top plate 1300 is made of a resin excelling in resistance to the ink, such as polysulfone, polyether sulfone, polyphenylene oxide, polypropylene, etc. It is integrally molded in a mold together with an orifice plate portion 400.

As above described, the integrally molded part comprises the ink supply passage member 600, the top plate-orifice plate integral and the ink container body. Therefore, the accuracy in the assembling is improved, and is extremely effective in the mass-production. The number of parts is smaller than that in the prior art, so that the good performance is assured.

SUMMARY OF THE INVENTION

The present inventors made extensive studies in order to improve the foregoing recording head. As a result, there were found some points to be improved on the foregoing recording head, which will be described below.

FIG. 3 is a schematic longitudinal section view taken along the ink pathways near the ejection outlets in the state wherein the heater board and the top plate are laminated in FIGS. 1 and 2. In FIG. 3, the top plate 1300 is laminated to the heater board 100. Reference numeral 411 stands for an ink pathway groove which is disposed at the top plate. Reference numeral 400 stands for an orifice plate which is formed integrally together with or laminated to the top plate 1300. Reference numeral 421 stands for an ejection outlet which is formed at the orifice plate 400. Reference numeral 501 stands for a pressure bar plate spring. The contact between the top plate 1300 and the heater board 100 is assured by urging the bottom face of the partition wall constituting the ink pathway groove of the top plate 1300 against the heater board 100 from the top plate 1300 side by means of the pressure bar plate spring 501.

The present inventors made studies of a structural variation and other related matters in the contact between the top plate and the heater board in the above constitution. As a result, the following were found.

(1) The contact of the heater board 100 with the top plate 1300 is performed by urging the face provided with an electrothermal converting element of the former against the face of the latter using the pressure bar plate spring as above described. A problem was found in this case. That is, such a clearance as indicated by "y" in FIG. 3 will be often caused at the composition plane between the two members mainly due to a variation in the precision of each of them upon their molding. Other than this, there will be sometimes occurred a step of 1 to 3 $\mu$m at the pattern formed on the heater board, and this leads to causing such clearance as above described. (The clearance in this case will be hereinafter referred to as "clearance y".)

(2) The contact between the end face of the heater board 100 and the orifice plate 400 is performed by striking one to the other while positioning them properly, and any other processing is not performed in usual case. A similar problem was found also in this case. That is, such a clearance of 2 to 10 $\mu$m in size as indicated by "x" in FIG. 3 is often caused upon the contact processing. (The clearance in this case will be hereinafter referred to as "clearance x".)

(3) Then, it was found that the following problems are caused when the clearance y or/and the clearance x is occurred. That is, (i) upon ejecting ink through the ejection outlet by actuating the electrothermal converting element, thermal energy for ejecting the ink is transmitted to the adjacent ink pathway through the clearance y or/and the clearance x to cause a so-called "crosstalk phenomenon" such that the ink is ejected also from the adjacent ejection outlet, the amount of the ink to be ejected from the corresponding ejection outlet is varied, and the like; (ii) since the ink ejecting thermal energy is transmitted to the adjacent ink pathway, the liquid drop ejected from the ejection outlet corresponding the actuated electrothermal converting element cannot attain the demanded volume; and (iii) the ink ejection speed is sometimes reduced by about 20 to 30%.

As a result of performing recording using such recording head liable to cause the cross talk phenomenon, there could not obtain a desirable record.

The present invention is aimed at eliminating the above problems found in the conventional ink jet recording head and providing an improved ink jet recording head free of those problems.

The present invention therefore makes it an object to provide an improved ink jet recording head characterized by having a first member provided with a plurality of energy generating elements corresponding to the ink ejection outlets and a second member; the first member and the second member being laminated; the second member being provided with (a) a plurality of ink pathway forming grooves to form ink pathways corresponding to the energy generating elements of the first member upon contact of the first member with the second member and (b) one or more protrusions at the face thereof to be in contact with the first member, said one or more protrusions being capable of being deformed upon contact with the first member through said face.

Another object of the present invention is to provide an improved ink jet recording head characterized by having a first member provided with a plurality of energy generating elements corresponding to the ink ejection outlets and a second member; the first member and the second member being laminated; the second member being provided with (a) a plurality of ink pathway forming grooves to form ink pathways corresponding to the heat generating elements of the first member upon contact of the first member with the second member, (c) an ejection outlet forming member provided with the ink ejection outlets in communication with the ink pathway forming grooves at their one ends, (d) step portions provided between the ejection outlet forming member and the ink pathway forming grooves, and (e) one or more protrusions at the face to be in contact with the first member through the step portions, said one or more protrusions being capable of being deformed upon contact with the first member.

A further object of the present invention is to provide an improved ink jet recording head characterized by having a first member provided with a plurality of energy generating elements corresponding to the ink ejection outlets and a second member; the first member and the second member being laminated; the second member being provided with (a) a plurality of ink pathway forming grooves to establish ink pathways corresponding to the heat generating elements of the first member upon contact of the first member with the second member, (b) one or more protrusions at the face thereof to be in contact with the first member, said one or more protrusions being capable of being deformed upon contact with the first member through said face, (c) an ejection outlet forming member provided with the ink ejection outlets in communication with the ink pathway forming grooves at their one ends, and (d) step portions provided between the ejection outlet forming member and the ink pathway forming grooves.

The ink jet recording head provided according to the present invention excels in contact between the top plate and the support member and provides an excellent recording performance wherein the respective ink pathways work independently without suffering from the foregoing problems relative to the transmittance of thermal energy for ejecting the ink to the adjacent ink pathway. These effects of the ink jet recording head according to the present invention are brought about because of the foregoing specific constitution, wherein the foregoing second member, for example, as the top plate is provided with one or more protrusions as above described at the face thereof to be in contact with the foregoing first member, for example, as the support member, and said one or more protrusions are crushed by press-contacting the two members, thereby assuring the contact between the two members.

DETAILED DESCRIPTION OF THE INVENTION

Figure 1:
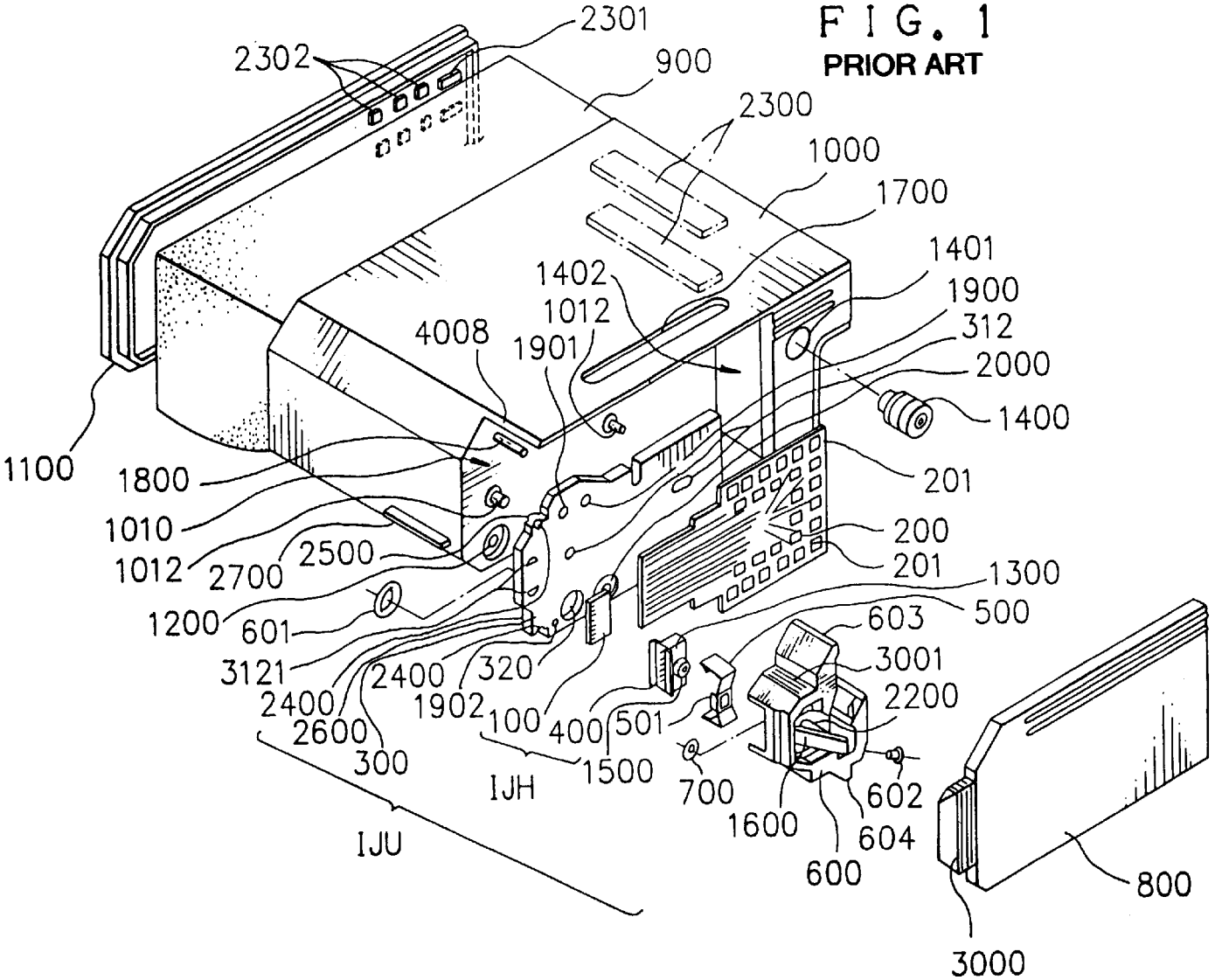
FIG. 1 PRIOR ART
FIG. 1 is a schematic exploded view of the conventional recording head-ink container integrated type head cartridge.

As above described, an object of the present invention is to eliminate the foregoing problems in the prior art that one or more clearances is often occurred at the composition plane formed by press-contacting the support member with the grooved top plate because of a variation in the processing precision of each of the two members; the presence of such clearance is apt to transmit the ink ejecting thermal energy in an ink pathway to other ink pathway adjacent thereto, thereby causing the foregoing cross talk phenomenon; and the ink jet recording head becomes defective in ink ejecting characteristics.

The improvement according to the present invention in the prior art lies in the configuration of the composition plane formed by press-contacting the support member with the grooved top plate wherein one or more protrusions (ribs in other words) capable of being deformed by the urging force upon press-contacting the two members at the composition plane. Particularly, the composition plane formed by press-contacting the support member with the grooved top plate contains a first region among the respective ink pathways and a second region among the respective ejection outlets and ink pathways, and one or more protrusions (ribs) are mounted at the first region or the second region or both of the first and second regions, said one or more protrusions (ribs) being capable of being deformed by the urging force upon press-contacting the two members. By this, the foregoing one or more clearances occurred at the composition plane formed by press-contacting the support member with the grooved top plate are filled up with the deformed protrusions (ribs), and as a result, a reliable contact state is attained for the composition plane of the support member with the grooved top plate. As for the protrusion (rib) to be mounted at the composition plane of the support member with the grooved top plate, it is sufficient to be at least a protruded zone formed along the ink pathway on the side where the partition wall portion to constitute the ink pathway on the grooved top plate side is in contact with the support member. It is a matter of course that the number of such protruded zone is not limited to one only but may be two or more with due care about the width of the partition wall portion on the grooved top plate side and also about the situation of the protrusion to be deformed by the foregoing urging force in order to further improve the assurance of the mutual close contact between the support member and the grooved top plate. Alternatively, it is possible to dispose the foregoing protruded zone not at the partition wall portion on the grooved top plate side but at the region on the support member side where the partition wall portion is contacted. In this case, the number of such protruded zone is not limited to one only but may be two or more with due care about the width of the partition wall portion on the grooved top plate side and also about the situation of the protrusion to be deformed by the foregoing urging force.

Further, it is possible to dispose one or more protruded zones (rib zones in other words) not only at part of the composition plane on the grooved top plate side and but also at part of the composition plane on the support member side such that the entire composition plane is provided with the protruded zones in a state where the support member is in contact with the grooved top plate. In this case, it is possible to configure such that a plurality of protruded zones (rib zones) are alternately arranged at the composition plane between the support member and the grooved top plate.

Other than what is above described, it is possible to dispose one or more protruded zones at the region among the respective ejection outlet and ink pathway as well as in the case of the foregoing region among the ink pathways. Particularly in this case, it can be configured such that a protruded zone is established along the direction of the ejection outlets being arranged on the composition plane side where the region among the respective ejection outlet and ink pathway on the grooved top plate side is in contact with the support member. It is a matter of course that the number of such protruded zone is not limited to one only but may be two or more with due care about the width of the partition wall portion on the grooved top plate side and also about the situation of the protrusion to be deformed by the foregoing urging force in order to further improve the assurance of the mutual close contact between the support member and the grooved top plate. In this case, it is possible to dispose one or more protruded zones (rib zones in other words) not only on the grooved top plate side and but also on the support member side such that the entire of the composition plane is provided with the protruded zones in a state where the support member is in contact with the grooved top plate.

Further in addition, it is possible to dispose one or more protruded zones (rib zones) at both the region among the ink pathways and the region among the respective ejection outlet and ink pathway. In this case, said one or more protruded zones may be disposed only on the grooved top plate side or only on the support member side. Alternatively, it is possible to dispose one or more protruded zones (rib zones) not only on the grooved top plate side and but also on the support member side such that the entire of the composition plane is provided with the protruded zones in a state where the support member is in contact with the grooved top plate. In this case, it is possible to configure such that a plurality of protruded zones (rib zones) are alternately arranged at the composition plane between the support member and the grooved top plate.

Further, it is possible to dispose a groove against the protruded zone (rib zone) disposed on the grooved top plate or the support member such that the groove corresponds to the protruded zone and to perform the contact between the support member and the grooved top plate while fitting the protruded zone to the groove. In this case, there are provided advantages that not only the the foregoing clearance can be desirably filled up but also the positioning of the grooved top plate and the support member can be properly performed. In consideration of the easiness in the production of the ink jet recording head and also of the production cost thereof, it is most desired to take the constitution in which one or more protruded zones (rib zones) are disposed on the grooved top plate side. And, in the case of forming the grooved top plate by means of injection molding technique, it is possible to easily dispose one or more protruded zones (rib zones) at the predetermined portion of the grooved top plate.

One aspect of this invention involves an ink jet head having an ejection outlet member having ejection outlets, plural energy generating elements for generating energy to be used for ejecting ink through the ejection outlets, plural ink pathways each communicated with each of the ejection outlets, and a liquid chamber communicated with the ink pathways. Other features of the invention include a support member having plural energy generating elements, a grooved top plate having grooves which define respective ink pathways, each groove having an axis of ink flow and a recess which defines the liquid chamber and the ejection outlet member with the ejection outlets, and a pressing means for press-contacting the support member and grooved top plate. The grooved top plate has a surface having the grooves on a side where the grooved top plate is contacted with the support member, the ejection outlet member has a contact portion to contact a face of the support member on which the energy generating elements are provided while the contact portion is extended in a direction of crossing the face of the support member and the axis of ink flow, and the contact portion has a protruded portion which is protruded above the surface of the grooved top plate.

PREFERRED EMBODIMENTS OF THE INVENTION

The advantages of the present invention will be described in more detail by reference to the following embodiments, which are provided merely for illustrating purposes only, and are not intended to limit the scope of the present invention.

Figure 2:
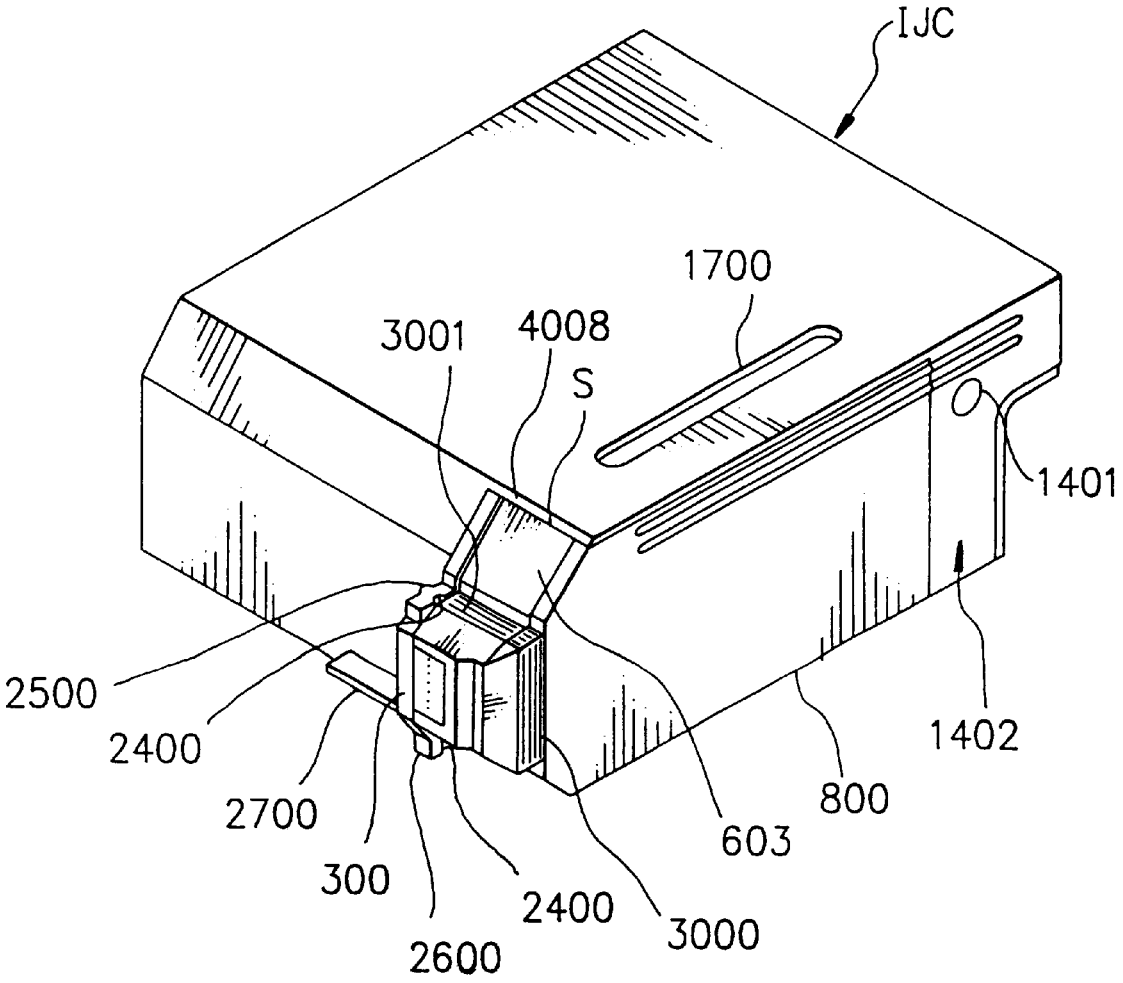
FIG. 2 PRIOR ART
FIG. 2 is a schematic view of the head cartridge shown in FIG. 1.
Figure 3:
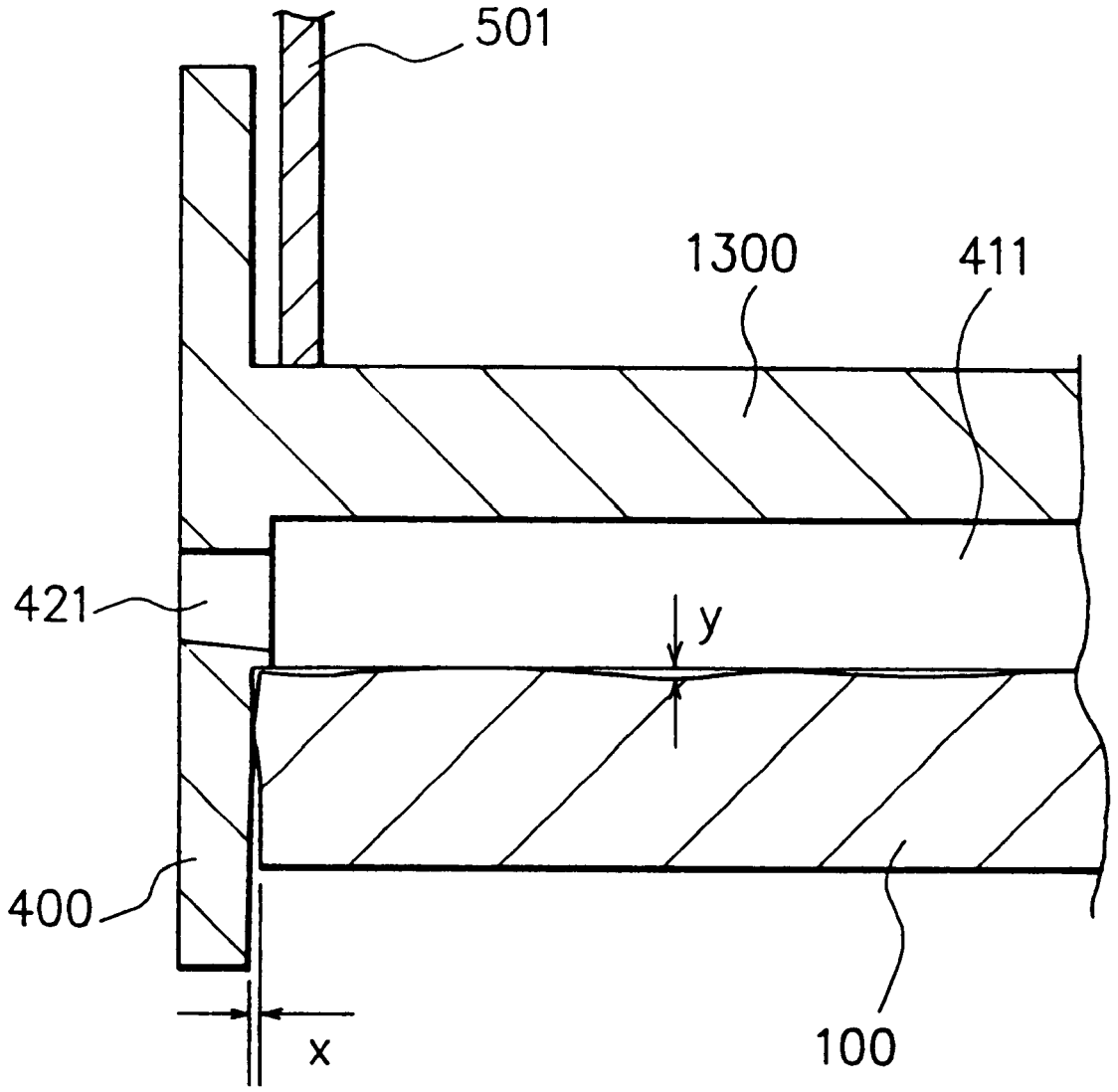
FIG. 3 PRIOR ART
FIG. 3 is a schematic view illustrating the state in which the top plate is contacted with the heater board.

In the drawings which are employed in the following embodiments, the same reference numerals as in FIGS. 1 and 2 are used as for the constituent members or portions corresponding to those in FIGS. 1 and 2.

Embodiment 1

Figure 4:
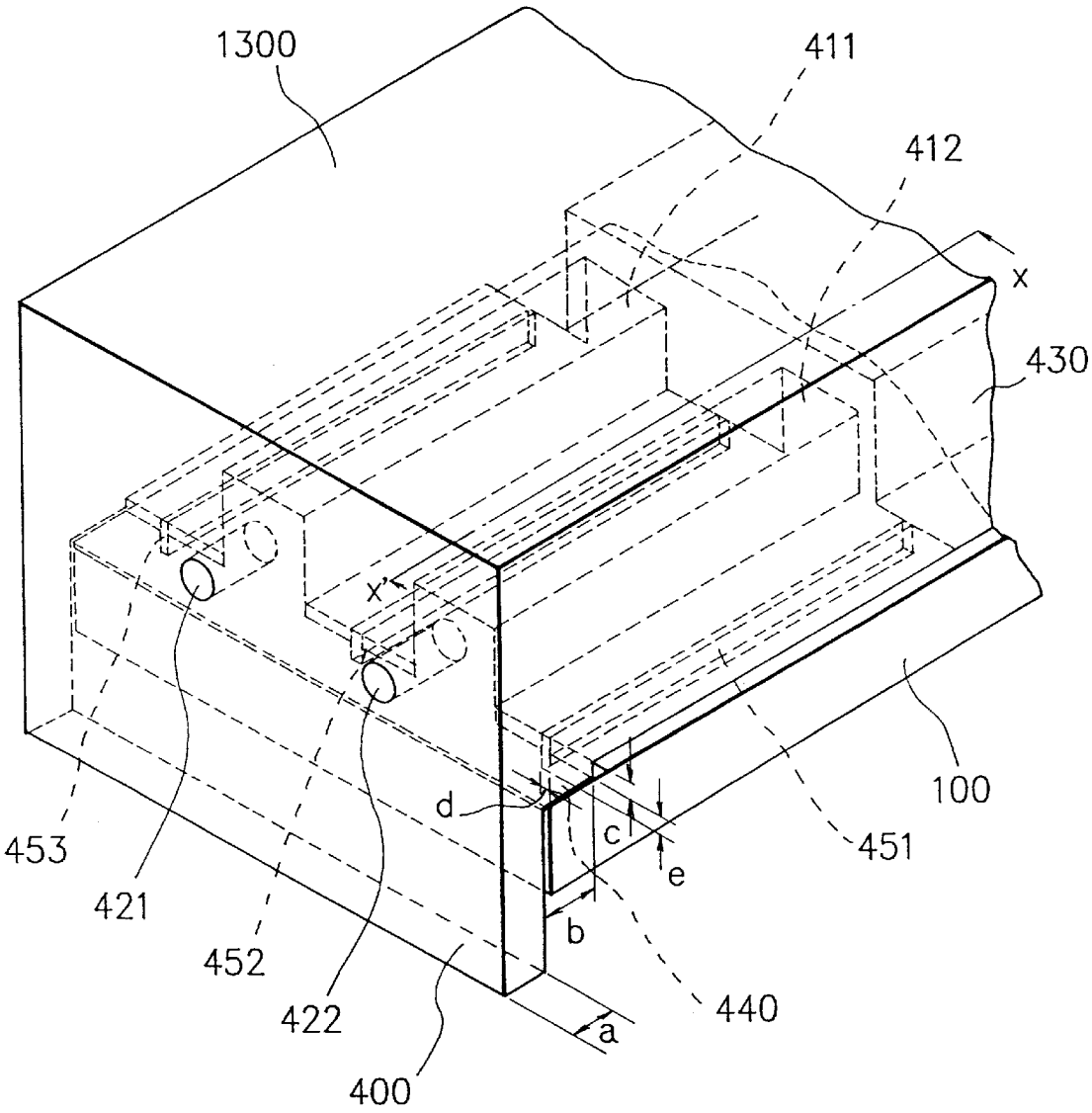
FIG. 4 is a schematic perspective view illustrating the top plate in an embodiment of the present invention.
Figure 5:
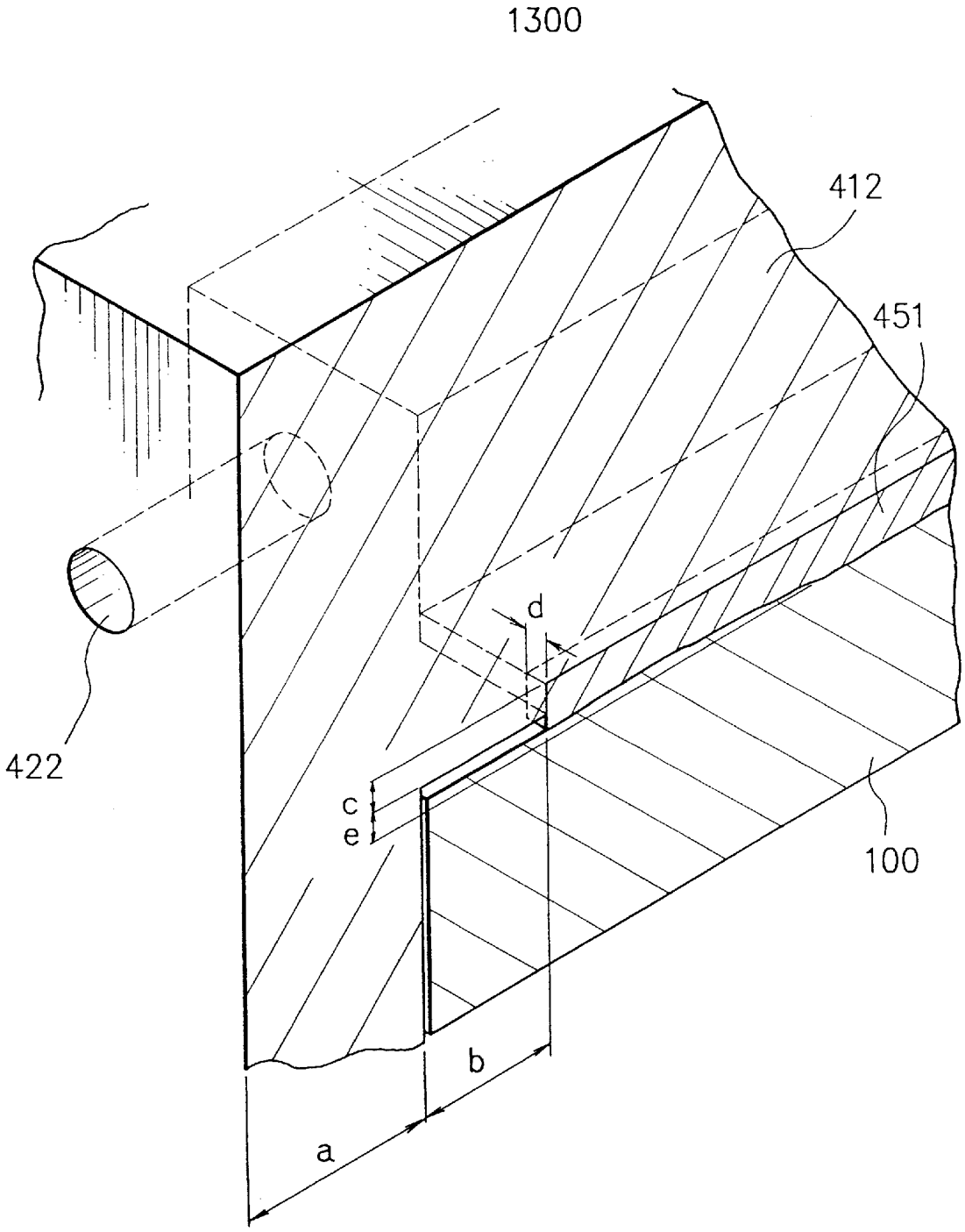
FIG. 5 is a schematic cross section view taken along line X–X' of the top plate shown in FIG. 4.

FIG. 4 is a schematic explanatory view of an embodiment of the top plate of the ink jet recording head according to the present invention. FIG. 5 is a schematic cross section view taken along line X–X' of the top plate shown in FIG. 4. Specifically, FIG. 5 illustrates a configuration of the ejection outlets of the top plate and heater board and the ink pathways in the neighborhood of them after the top plate has been contacted with the heater board and the pressure bar plate spring (not shown) has been disposed.

In FIG. 4, each of reference numerals 421 and 422 stands for an ejection outlet, and each of reference numerals 411 and 412 stands for a groove for ink pathway (hereinafter referred to as ink pathway groove) which is in communication with the corresponding ejection outlet and also in communication with a common liquid chamber-forming recession 430.

In this embodiment, the top plate 1300 is formed integrally with an orifice plate 400 in a molding device using a resin excelling in resistance to ink such as polysulfone, polyether sulfone, polyphenylene oxide, polypropylene, etc.

Explanation will be made of the manner of forming the ink pathway grooves 411 and 412 and the ejection outlets 421 and 422.

The ink pathway grooves were formed by introducing a resin into a mold having grooved patterns reverse to said ink pathway grooves, followed by subjecting to curing. By this, the ink pathway grooves 411 and 412 are disposed at the top plate 1300.

The ejection outlets 421 and 422 were formed by irradiating ultraviolet rays from excimer laser to the positions where these ejection outlets are to be formed from the side inside the orifice plate 400, specifically from the ink pathway groove side to remove or evaporate the resin.

In this embodiment, the molding was performed to provide a 40 μm width for the ink pathway groove, a 23.5 μm width for the non-grooved portion, and a 50 μm height (depth) for the ink pathway groove.

In the figure, the number of the ink pathway grooves is only two for simplification purposes. Actually, 90 ink pathway grooves and 74 ejection outlets were formed.

In this embodiment, there were prepared a plurality of top plates. That is, in the above, the thickness a of the orifice plate in the figure was varied in the region of 10 μm to 60 μm. And a step 440 (hereinafter referred to as jaw portion) was formed between the end face position of the ink pathway groove and the inside face of the orifice plate 440 (that is, the face on the ink pathway side) in each case. The size b of the jaw portion was varied in the range of 3 to 50 μm. The size c of the step face between the jaw portion and the bottom face of the partition wall was also varied in the range of 0 μm to 10 μm.

Further, protruded forms 451, 452 and 453 (hereinafter referred to as ribs) were formed at the bottom face of the partition wall. The width d of these ribs was varied in the range of 1 μm to 7 μm, and the distance e between the top face of the rib and the step face of the jaw 440 was varied in the range of 0 μm to 5 μm.

Thus, there were obtained a plurality of top plates (Samples 1 to 21) which are different in one or more of the sizes a, b, c, d and e as shown in Table 1.

In Table 1, the top plates of Samples Nos. 1 to 5 are of 20 μm for the thickness a of the orifice plate, 3 μm for the size c between the jaw portion 440 and the bottom face of the ink pathway wall, 3 μm and 2 μm for the sizes relative to the rib, and which are different with respect, to the size b (that is, the width of the jaw portion) in the range of 3 μm to 50 μm.

And, the top plates of Samples Nos. 6 to 9 are of 10 μm for the width b of the jaw portion 440, 3 μm for the size c between the jaw portion 440 and the bottom face of the ink pathway wall, 3 μm and 2 μm for the sizes relative to the rib, and which are different with respect to the thickness a of the orifice plate in the range of 5 μm to 50 μm.

Likewise, the top plates of Samples Nos. 10 to 13 are different with respect to the size c in the range of 0 μm to 10 μm; the top plates of Samples Nos. 14 to 17 are different with respect to the size d in the range of 1 μm to 7 μm; and the top plates of Samples Nos. 18 to 21 are different with respect to the size e in the range of 0 μm to 5 μm.

Using the resultant top plates, twenty one kinds of ink jet recording heads were obtained.

In assembling each of the ink jet recording heads, the ribs 451, 452 and 453 are made to be in contact with the heater board and these ribs are crashed by the urging force from the top plate. By this, the close contact between the bottom face of the top plate's partition wall and the heater board is improved to prevent occurrence of the foregoing cross talk phenomenon.

These ribs are not always necessary to be formed at the time of producing the top plate. For instance, protrusions by burrs caused upon the production of the top plate can be utilized as the ribs. In addition, it is possible to dispose an appropriate sealing member at the contact portion between the top plate's partition wall and the heater board in order to assure the contact between them. As such sealing member, there can be illustrated urethan resins, acrylic resins, flexible epoxy resins, rubber adhesives, and the like, among these, elastomeric members being the most desirable.

For comparison purposes, there were mentioned three comparative top plates (Comparative Samples 1 to 3) of the conventional configuration described in the above prior art in Table 1. Using these comparative top plates, there were obtained three ink jet recording heads (hereinafter referred to as comparative ink jet recording head samples Nos. 1 to 3).

As for each of the twenty-one ink jet recording heads (hereinafter referred to as ink jet recording head samples Nos. 1 to 21 and also as for each of the three comparative ink jet recording head samples Nos. 1 to 3, there were performed evaluations with respect to (a) molding ability, (b) easiness for orifice formation (easiness for the formation of ejection outlets in other words) and (c) the situation with respect to occurrence of the foregoing cross talk phenomenon in view of head characteristics.

With respect to the evaluation item (a), when the thickness a of the orifice plate 400 of the top plate and the width d of the rib are excessively small, the flow of a resin upon the molding becomes insufficient and it becomes difficult to attain desired molding. With respect to the evaluation item (b), the ejection outlets were formed using an excimer laser in this embodiment, but when the size until penetrating a hole by irradiating said laser, particularly, the size comprising the sum (a+b) of the thickness a of the orifice plate and the size b relative to the jaw portion is excessively large, a desired size for the ejection outlet cannot be attained because there is a limit for the laser power. With respect to the evaluation item (c), recording was performed on a paper and the quality of the recorded product was observed.

In Table 1, there were collectively shown the evaluated results with respect to the above three evaluation items as for each of the ink jet recording head samples Nos. 1 to 21 and also as for each of the comparative ink jet recording head samples Nos. 1 to 3. In Table 1, the mark "○" means the case where the evaluated result was good, the mark "Δ" means the case where the evaluated result was practically acceptable, and the mark "X" means the case where the evaluated result was practically unacceptable.

From the evaluated results, the following facts were found. That is, Sample No. 1 was good with each of the evaluation items (a) and (b), but as for the ink jet recording head sample No. 1, cross talk phenomenon was occurred. Because of this, the ink jet recording head assembled using the top plate of Sample No. 1 is not acceptable. The ink jet recording head sample No. 2 assembled using the top plate of Sample No. 2, which showed a good result with respect to each of the evaluation items (a) and (b), was better than the ink jet recording head sample No. 1 with respect to the evaluation item (c) (occurrence of cross talk phenomenon), but some cross talk phenomenon occurred. Thus, the ink jet recording head sample No. 2 is not a complete one. The reason for this is considered due to incomplete contact of the jaw portion with the heater board because of small size (5 μm) for the jaw portion, wherein the ejecting thermal energy is leaked into the adjacent ink pathway.

The top plate of Sample No. 3 showed satisfactorily good results with respect to each of the evaluation items (a) and (b), and the ink jet recording head sample No. 3 assembled using the top plate of Sample No. 3 provided an excellent record product without causing cross talk phenomenon.

The top plate of Sample No. 4 (40 μm for the size of the jaw portion) was good with respect to the evaluation item (a) (molding ability). But it was not satisfactory with respect to the evaluation item (b) (that is, the orifice formation was difficult). Particularly in this respect, since the sum of 20 μm for the thickness a of the orifice plate 400 and said 40 μm for the size of the jaw portion became 60 μm (undesirably thick), it took a long period of time in order to obtain desirable ejection outlets by performing laser processing. However, the ink jet recording head sample No. 4 assembled using the top plate of Sample No. 4 provided a high quality record product without causing cross talk phenomenon. In the case of the top plate of Sample No. 5 (50 μm for the size of the jaw portion), it was impossible to obtain desired ejection outlets even by changing the laser processing conditions in any way. Thus, the ink jet recording head sample No. 5 was not prepared.

In the case of the top plate of Sample No. 6 (10 μm for the thickness a of the orifice plate), it was impossible to form a desired orifice plate because the resin was not flown as desired. Thus, evaluation was not performed with respect to the remaining evaluation item.

The top plate of Sample No. 7 (20 μm for the thickness a for the orifice plate) showed satisfactorily good result with respect to each of the evaluation items (a) and (b), and the ink jet recording head sample No. 7 assembled using the top plate of Sample No. 7 provided an excellent record product without causing cross talk phenomenon. As for the top plate of Sample 8 (50 μm for the thickness a of the orifice plate), it was somewhat inferior to Sample No. 7 with respect to the evaluation item (b), but the ink jet recording head sample No. 8 assembled using the top plate of Sample No. 8 provided a high quality record product without causing cross talk phenomenon.

In the case of the top plate of Sample No. 9 (60 μm for the thickness a of the orifice plate), desirable orifice processing could not be performed because the thickness to be subjected to the orifice processing using laser became markedly thick (70 μm). Thus, evaluation was not performed with respect to the remaining evaluation item.

The evaluated results will be described as for each of Samples Nos. 10 to 13 which are different in the size c for the step face between the jaw portion and the bottom face of the partition wall in the range of 0 μm to 10 μm.

In the case of the top plate of Sample No. 10 (0 μm for the size c; that is, the jaw portion and the bottom face of the partition wall are on an identical face), it showed good results with respect to each of the evaluation items (a) and (b). But the ink jet recording head sample No. 10 assembled using the top plate of Sample No. 10 caused cross talk phenomenon and did not provide a desirable record product. This is considered to be due to a reason that the ribs 451, 452 and 453 were not sufficiently crushed even by pressing by means of the pressure bar plate spring and because of this, the jaw portion was not close-contacted with the heater board, whereby ejection thermal energy was leaked into the adjacent ink pathway.

As for the top plate of Sample No. 11 (1 μm for the size c) and the top plate of Sample No. 12 (5 μm for the size c), any of them showed satisfactory good results with respect of the evaluation items (a) and (b). And any of the ink jet recording head samples Nos. 11 and 12 assembled using these top plates provided an excellent record product without causing cross talk phenomenon.

The top plate of Sample No. 13 (10 μm for the size c) showed no good results (practically unacceptable result) with respect to the evaluation item (a) and good results with respect to the evaluation item (b). The ink jet recording head sample No. 13 assembled using this top plate caused cross talk phenomenon and did not provide a desirable record product. As the reason for this, it is considered that desirable ribs were not formed because sufficient resin flow was not attained due to excessively long length and because of this, leakage of ejecting thermal energy into the adjacent ink pathway was occurred.

The evaluated results will be described as for each of Samples Nos. 14 to 17 which are different in the size d for the width of the rib in the range of 1 μm to 7 μm.

In the case of the top plate of Sample No. 14 (1 μm for the size d), desirable resin flow could not be attained and because of this, desirable ribs could not be formed. Therefore, evaluation was not performed with respect to the remaining evaluation item.

As for the top plate of Sample No. 15 (2 μm for the size d) and the top plate of Sample No. 16 (5 μm for the size d), any of them showed satisfactory good results with respect of the evaluation items (a) and (b). And any of the ink jet recording head samples Nos. 15 and 16 assembled using these top plates provided an excellent record product without causing cross talk phenomenon.

The top plate of Sample No. 17 (7 μm for the size d) showed practically unacceptable results with respect to the evaluation item (a) but good results with respect to the evaluation item (b). Particularly, the ribs were excessively strong in intensity and because of this, those ribs were not sufficiently crushed. The ink jet recording head sample No. 17 assembled using this top plate caused cross talk phenomenon and did not provide a desirable record product.

The evaluated results will be described as for each of Samples Nos. 18 to 21 which are different in the size e (that is, the distance e between the top face of the rib and the jaw portion) in the range of 0 μm to 5 μm.

The top plate of Sample No. 18 (0 μm for the size e; that is, the top face of the rib and the jaw portion are on an identical plane) showed good results with respect to each of the evaluation items (a) and (b). But the ink jet recording head sample No. 18 assembled using this top plate often caused somewhat cross talk phenomenon and did not stably provide a desirable record product. As the reason for this, it is considered that the contact of the rib portions with the heater board was not sufficient enough and because of this, some leakage of ejecting thermal energy into the adjacent ink pathway occurred.

As for the top plate of Sample No. 19 (1 μm for the size e) and the top plate of Sample No. 20 (3 μm for the size e), any of them showed satisfactory good results with respect of the evaluation items (a) and (b). And any of the ink jet recording head samples Nos. 19 and 20 assembled using these top plates provided an excellent record product without causing cross talk phenomenon.

The top plate of Sample No. 21 (5 μm the size e) showed practically unacceptable results with respect to the evaluation item (a) but good results with respect to the evaluation item (b). Particularly, desirable resin flow could not be attained and because of this, desirable ribs could not be formed. The ink jet recording head sample No. 21 assembled using this top plate caused cross talk phenomenon and did not provide a desirable record product.

As for each of the top plates of Comparative Samples 1 to 3 having neither such jaw portion nor such rib as in the present invention, a good result was obtained with respect to each of the evaluation items (a) and (b). But any of the comparative ink head recording heads assembled using these top plates caused remarkable cross talk phenomenon and did not provide a desirable record product.

From the evaluated results above described, the following facts were recognized.

That is, (i) as for the size b relative to the jaw portion, it is desired to be 5 μm or more wherein cross talk phenomenon is prevented from occurring; (ii) in view of molding ability, the thickness a of the orifice plate is necessary to be 15 μm or more; (iii) in view of the orifice processing using excimer laser, the sum (a+b) of the size a and the size b is necessary to be 60 μm or less; (iv) the size c is necessary to be in the region of 1 to 5 μm (that is, the bottom face of the ink pathway's partition wall is necessary to be floated by 1 to 5 μm against the jaw portion); (v) the size d (that is, the width d of the rib) is necessary to be in the range of 2 to 5 μm wherein desirable molding ability can be attained and the resulting ink jet recording head becomes free of occurrence of cross talk phenomenon; and (vi) the size e (that is, the distance e between the top face of the rib and the jaw portion) is necessary to be in the range of 1 to 3 μm wherein desirable molding ability can be attained and the resulting ink jet recording head becomes free of occurrence of cross talk phenomenon.

In consequence, it was found that a desirable ink jet recording head capable of stably and repeatedly providing a high quality record product can be obtained in the case where the following conditions are fulfilled:

$$b \geqq 5\ \mu m$$

$$20\ \mu m \leqq a+b \leqq 60\ \mu m$$

$$1\ \mu m \leqq c \leqq 5\ \mu m$$

$$2\ \mu m \leqq d \leqq 5\ \mu m$$

$$1\ \mu m \leqq e \leqq 3\ \mu m$$

Embodiment 2

Figure 6:
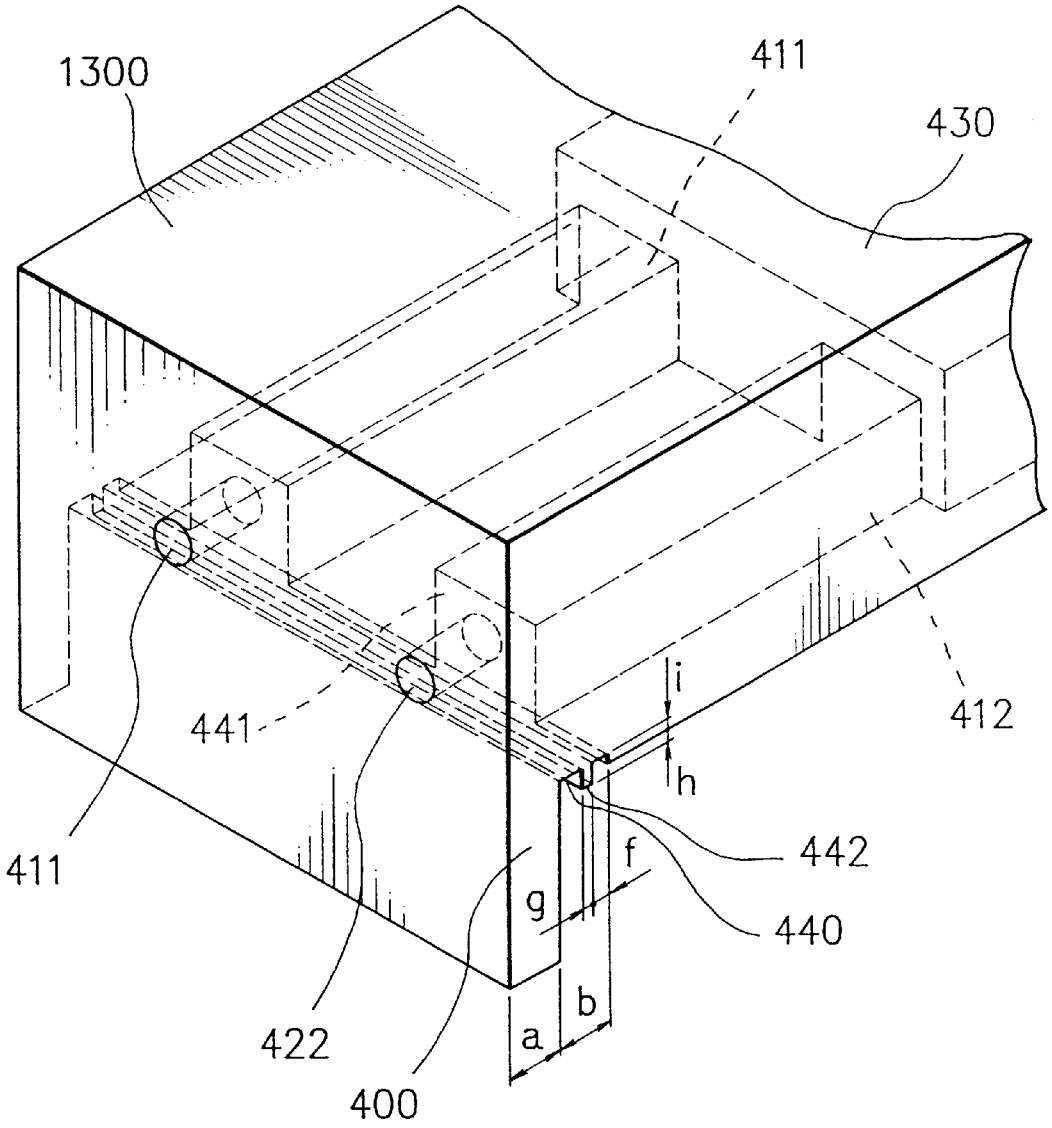
FIG. 6 is a schematic perspective view illustrating the top plate in other embodiment of the present invention.
Figure 7:
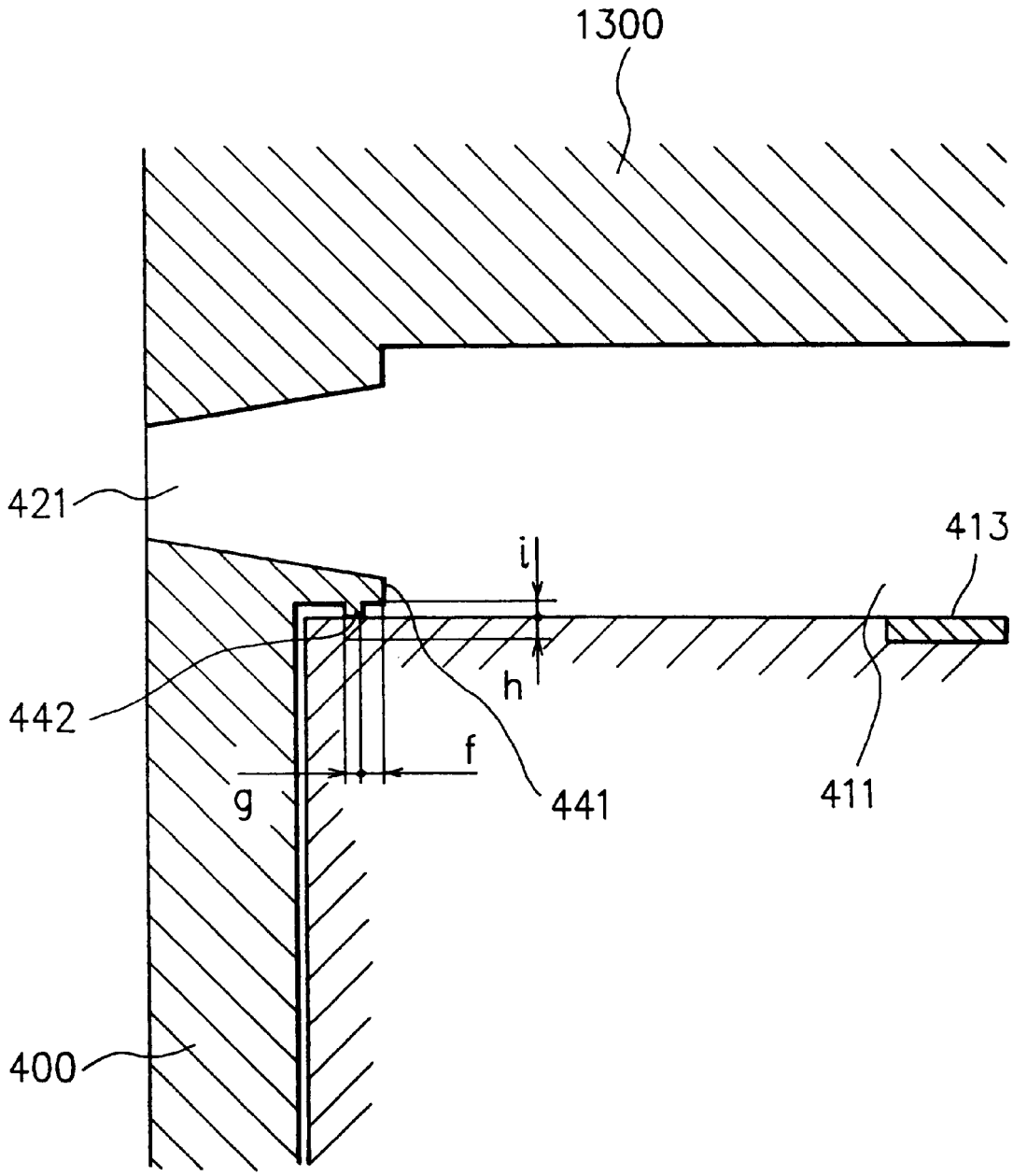
FIG. 7 is a schematic cross section view of the top plate shown in FIG. 6.

FIG. 6 is a schematic explanatory view of another embodiment of the top plate of the ink jet recording head according to the present invention. FIG. 7 is a schematic cross section view of the top plate shown in FIG. 6. Specifically, FIG. 7 illustrates a configuration of the ejection outlets of the top plate and heater board having energy generating elements 413 and the ink pathways in the neighborhood of them after the top plate has been contacted with the heater board and the pressure bar plate spring (not shown) has been disposed.

The configuration of the top plate shown in FIGS. 6 and 7 is the same as that of the top plate shown in FIGS. 4 and 5, except that the rib is disposed not at the composition plane among the respective ink pathways as in Embodiment 1 but at the composition plane between the support member and the grooved top plate. Particularly, in the configuration shown in FIGS. 6 and 7, a protruded zone (that is, a rib zone) is disposed in the region between the ejection outlets and the end portion of the ink pathway and on the side of the composition plane of the grooved top plate with the support member along along the direction of the ejection outlets being arranged. And, as for the configuration of the ink jet recording head to be assembled in this embodiment, it was made the same as that in Embodiment 1.

In this embodiment, the molding was performed to provide a 40 μm width for the ink pathway groove, a 23.5 μm width for the non-grooved portion (partition wall in other words), and a 50 μm height (depth) for the ink pathway groove.

In the figure, the number of the ink pathway grooves is only two for simplification purposes. Actually, 90 ink pathway grooves and 74 ejection outlets were formed.

In this embodiment, there were prepared twenty seven top plates (that is, Samples Nos. 22 to 48). That is, in the above, the thickness a of the orifice plate 400 in the figure was varied in the region of 10 μm to 60 μm. And a step 440 (hereinafter referred to as jaw portion) was formed between the end face position of the ink pathway groove and the inside face of the orifice plate 440 (that is, the face on the ink pathway side) in each case. The size b of the jaw portion was varied in the range of 3 to 50 μm. The size i (that is, the distance i) between the lower face of the jaw portion and the face in contact with the heater board (that is, the lower face of the partition wall) was also varied in the range of 0 μm to 5 μm. Further, a protruded portion 442 (hereinafter referred to as rib) was mounted on the lower face side of the jaw portion, and the size f (that is, the distance f) between this and the end face of the ink pathway groove was varied in the range of 0 μm to 10 μm. Further in addition, the size g (that is, the width g) of the rib 442 was varied in the range of 1 μm to 6 μm, and the size h (that is, the length h) of the rib to be crashed upon pressure contact with the heater board was also varied in the range of 0 μm to 5 μm.

Thus, there were prepared twenty seven top plates (Samples Nos. 22 to 48) which are different in one or more of the sizes a, b, f, g, h and i as shown in Table 2.

As is apparent from what shown in Table 2, the top plates of Samples Nos. 22 to 27 are of 20 μm for the size a (that is, the thickness a of the orifice plate), 2 μm for the size i, and 4 μm, 3 μm and 2 μm respectively for the sizes f, g and h relative to the rib 442, and which are different respectively with respect to the size b (that is, the width b of the jaw portion) in the range of 7 to 60 μm.

The top plates of Samples Nos. 28 to 31 are of 20 μm for the size a (that is, the thickness a of the orifice plate), 10 μm for the size b (that is, the width b of the jaw portion), and 4 μm, 3 μm and 2 μm respectively for the sizes f, g and h relative to the rib 442, and which are different respectively with respect to the size i in the range of 0 to 60 μm.

The top plates of Samples Nos. 32 to 36 are of 20 μm for the size a (that is, the thickness a of the orifice plate), 20 μm for the size b (that is, the width b of the jaw portion), 2 μm for the size i, and 3 μm and 2 μm respectively for the sizes g and h relative to the rib 442, and which are different respectively with respect to the size f in the range of 0 to 10 μm.

The top plates of Samples Nos. 37 to 40 are of 20 μm for the size a (that is, the thickness a of the orifice plate), 10 μm for the size b (that is, the width b of the jaw portion), 2 μm for the size i, and 4 μm and 2 μm respectively for the sizes f and h relative to the rib 442, and which are different respectively with respect to the size g in the range of 1 to 6 μm.

The top plates of Samples Nos. 41 to 44 are of 20 μm for the size a (that is, the thickness a of the orifice plate), 10 μm for the size b (that is, the width b of the jaw portion), 2 μm for the size i, and 4 μm and 3 μm respectively for the sizes f and g relative to the rib 442, and which are different respectively with respect to the size h in the range of 0 to 5 μm.

The top plates of Samples Nos. 45 to 48 are of 10 μm for the size b (that is, the width b of the jaw portion), 2 μm for the size i, and 4 μm, 3 μm and 2 μm respectively for the sizes f, g and h relative to the rib 442, and which are different respectively with respect to the size a (that is, the thickness a of the orifice plate) in the range of 5 to 70 μm.

Using the resultant top plates, a plurality of kinds of ink jet recording heads were obtained.

In assembling each of the ink jet recording heads, the rib 442 is made to be in contact with the heater board, wherein the rib is crushed by the urging force. By this, the close contact between the jaw portion's bottom face of the top plate and the heater board is improved to prevent occurrence of the foregoing cross talk phenomenon.

The rib is not always necessary to be formed at the time of producing the top plate. For instance, a protrusion by a burr caused upon the production of the top plate can be utilized as the rib. In addition, it is possible to dispose an appropriate sealing member at the contact portion between the top plate's jaw portion and the heater board in order to assure the contact between them. As such sealing member, there can be illustrated urethan resins, acrylic resins, flexible epoxy resins, rubber adhesives, and the like, among these, elastomeric members being the most desirable.

As for any of the resultant ink jet recording heads, it was found that the heater board had been substantially close-contacted with the top plate's partition wall by the action of the pressure bar plate spring without leaving a distinguishable clearance.

In Table 2, for comparison purposes, there were mentioned three comparative top plates (Comparative Samples 4 to 6) of the conventional configuration described in the above prior art, having neither such jaw portion nor such rib as in the present invention. Using these comparative top plates, there were obtained three ink jet recording heads (hereinafter referred to as comparative ink jet recording head samples Nos. 4 to 6).

As for each of the resultant ink jet recording heads (hereinafter referred to as ink jet recording head samples Nos. 22 to 48) and also as for each of the three comparative ink jet recording head samples Nos. 4 to 6, there were performed evaluations with respect to (a) molding ability, (b) easiness for orifice formation (easiness for the formation of ejection outlets in other words) and (c) the situation with respect to occurrence of the foregoing cross talk phenomenon in view of head characteristics.

With respect to the evaluation item (a), when the thickness a of the orifice plate 400 of the top plate and the width g of the rib are excessively small, the flow of a resin upon the molding becomes insufficient and it becomes difficult to attain desired molding. With respect to the evaluation item (b), the ejection outlets were formed using excimer laser in this embodiment, but when the size until penetrating a hole by irradiating said laser, particularly, the size comprising the sum (a+b) of the thickness a of the orifice plate and the size b relative to the jaw portion is excessively large, a desired size for the ejection outlet cannot be attained because there is a limit for the laser power. With respect to the evaluation item (c), recording was performed on a paper and the quality of the record product was observed.

In Table 2, there were collectively shown the evaluated results with respect to the above three evaluation items as for each of the ink jet recording head samples Nos. 22 to 48 and also as for each of the comparative ink jet recording head samples Nos. 4 to 6. In Table 2, the mark "Ω" means the case where the evaluated result was good, the mark "Δ" means the case where the evaluated result was practically acceptable, and the mark "X" means the case where the evaluated result was practically unacceptable.

The evaluated results will be described as for each of Samples Nos. 22 to 27 which are different in the size b in the range of 7 μm to 60 μm.

From the evaluated results, the following facts were found. That is, the top plate of Sample No. 22 (7 μm for the width of the jaw portion) was good with each of the evaluation items (a) and (b), but the ink jet recording head sample No. 22 assembled using this top plate caused cross talk phenomenon and did not provide a desirable record product. Thus, this ink jet recording head was found to be practically unacceptable. As for the reason for this, it is considered that the rib was not sufficiently crushed.

The top plates of Samples Nos. 23 to 26 showed good results with respect to each of the evaluation items (a) and (b), and any of the ink jet recording head samples No. 23 to 26 assembled using these top plates provided an excellent record product without causing cross talk phenomenon.

The top plate of Sample No. 27 (60 μm for the size b) showed good results with respect to the evaluation item (a) but practically unacceptable results with respect to the evaluation item (b). Particularly, desirable ejection outlets could not be obtained even by changing the laser processing conditions in any way. The ink jet recording head sample No. 27 assembled using this top plate often caused cross talk phenomenon and did not stably provide a desirable record product.

The evaluated results will be described as for each of Samples Nos. 28 to 31 which are different in the size i in the range of 0 μm to 5 μm.

In the case of the top plate of Sample No. 28 (0 μm for the size i; that is, the lower face of the jaw portion and the composition plane with the heater board are on an identical face), it showed good results with respect to each of the evaluation items (a) and (b). But the ink jet recording head sample No. 28 assembled using this top plate caused cross talk phenomenon and did not provide a desirable record product. As the reason for this, it is considered that the rib 442 was not sufficiently crushed even by pressing by means of the pressure bar plate spring and because of this, ejecting thermal energy was leaked into the adjacent ink pathway.

As for the top plate of Sample No. 29 (1 μm for the size i) and the top plate of Sample No. 30 (3 μm for the size i), any of them showed satisfactory good results with respect of the evaluation items (a) and (b). And any of the ink jet recording head samples Nos. 29 and 30 assembled using these top plates provided an excellent record product without causing cross talk phenomenon.

The top plate of Sample No. 31 (5 μm for the size i) showed not good results (practically unacceptable results) with respect to the evaluation item (a) but good results with respect to the evaluation item (b). The ink jet recording head sample No. 31 assembled using this top plate caused cross talk phenomenon and did not provide a desirable record product. As the reason for this, it is considered that a desirable rib 442 was not formed because sufficient resin flow was not attained, and leakage of ejecting thermal energy into the adjacent ink pathway occurred.

The evaluated results will be described as for each of Samples Nos. 32 to 36 which are different in the size f in the range of 0 μm to 10 μm.

The top plate of Sample No. 32 (0 μm for the size f) showed practically unacceptable results with respect to the evaluation item (a) but good results with respect to the evaluation item (b). The ink jet recording head sample assembled using this top plate caused cross talk phenomenon and did not provide a desirable record product. As the reason for this, it is considered that the side face of the rib 442 was integrated with the end face of the ink pathway and because of this, the rib 442 could not be sufficiently crushed even by the urging force by means of the pressure bar plate spring, whereby the ink jet recording head sample became defective.

As for the top plate of Sample No. 33 (1 μm for the size f), the top plate of Sample No. 34 (4 μm for the size f), the top plate of Sample No. 35 (7 μm for the size f) and the top plate of Sample No. 36 (10 μm for the size f), any of them showed satisfactory good results with respect of each of the evaluation items (a) and (b). And any of the ink jet recording head samples Nos. 33, 34, 35 and 36 assembled using these top plates provided an excellent record product without causing cross talk phenomenon.

The evaluated results will be described as for each of Samples Nos. 37 to 40 which are different in the size g in the range of 1 μm to 6 μm.

The top plate of Sample No. 37 (1 μm for the size g) showed practically unacceptable results with respect to the evaluation item (a) but good results with respect to the evaluation item (b). And the ink jet recording head sample No. 37 assembled using this top plate caused cross talk phenomenon and did not provide a desirable record product. As the reason for this, it is considered that a desirable rib 442 was not formed because desirable resin flow could not be attained, and because of this, the resultant ink jet recording head sample became deffective.

As for the top plate of Sample No. 38 (2 μm for the size g) and the top plate of Sample No. 39 (4 μm for the size g), any of them showed satisfactory good results with respect of each of the evaluation items (a) and (b). And any of the ink jet recording head samples Nos. 38 and 39 assembled using these top plates provided an excellent record product without causing cross talk phenomenon.

The top plate of Sample No. 40 (6 μm for the size g) showed practically acceptable results with respect to each of the evaluation items (a) and (b). But the ink jet recording head sample No. 40 assembled using this top plate caused cross talk phenomenon and did not provide a desirable record product. As the reason for this, it is considered that the rib 442 was not sufficiently crushed because it has a relatively large width and was rigid, and because of this, the resultant ink jet recording head sample became defective.

The evaluated results will be described as for each of Samples Nos. 41 to 44 which are different in the size h in the range of 0 μm to 5 μm.

The top plate of Sample No. 41 (0 μm for the size h) showed good results with respect to each of the evaluation items (a) and (b). But the ink jet recording head sample No. 41 assembled using this top plate caused cross talk phenomenon and did not provide a desirable record product. As the reason for this, it is considered that the contact of the rib 442 with the heater board was insufficient, and because of this, the resultant ink jet recording head sample became deffective.

As for the top plate of Sample No. 42 (1 μm for the size h) and the top plate of Sample No. 43 (3 μm for the size h), any of them showed satisfactory good results with respect of each of the evaluation items (a) and (b). And any of the ink jet recording head samples Nos. 42 and 43 assembled using these top plates provided an excellent record product without causing cross talk phenomenon.

The top plate of Sample No. 44 (5 μm for the size h) showed practically acceptable results with respect to each of the evaluation items (a) and (b). But the ink jet recording head sample No. 44 assembled using this top plate caused cross talk phenomenon and did not provide a desirable record product. As the reason for this, it is considered that the rib 442 was not crushed even by urging by means of the pressure bar plate spring, and because of this, the resultant ink jet recording head sample became defective.

The evaluated results will be described as for each of Samples Nos. 45 to 48 which are different in the size a (that is, the thickness a of the orifice plate) in the range of 5 μm to 70 μm.

The top plate of Sample No. 45 (5 μm for the size a) showed practically unacceptable results with respect to each of the evaluation items (a) and (b). And the ink jet recording head sample No. 45 assembled using this top plate caused cross talk phenomenon and did not provide a desirable record product. As the reason for this, it is considered that a desirable top plate could not be formed because the resin was not flown to the orifice plate portion, and because of this, the resultant ink jet recording head sample became deffective.

As for the top plate of Sample No. 46 (10 μm for the size a) and the top plate of Sample No. 47 (50 μm for the size a), any of them showed satisfactory good results with respect of each of the evaluation items (a) and (b). And any of the ink jet recording head samples Nos. 46 and 47 assembled using these top plates provided an excellent record product without causing cross talk phenomenon.

The top plate of Sample No. 48 (70 μm for the size a) showed good results with respect to the evaluation item (a) but practically unacceptable results with respect to the evaluation item (b). And the ink jet recording head sample No. 48 assembled using this top plate caused cross talk phenomenon and did not provide a desirable record product. As the reason for this, it is considered that desirable ejection outlets could not be formed even by changing the laser processing conditions in any way, and because of this, the resultant ink jet recording head sample became defective.

As for each of the top plates of Comparative Samples 4 to 6 having neither such jaw portion nor such rib as in the present invention, a good result was obtained with respect to each of the evaluation items (a) and (b). But any of the comparative ink head recording heads samples No. 4 to 6 assembled using these top plates caused remarkable cross talk phenomenon and did not provide a desirable record product.

From the evaluated results above described, the following facts were recognized.

That is, (1) the size with respect each of the jaw portion and the rib satisfies the requirements relative to the molding ability and prevention of occurrence of cross talk phenomenon as long as the size i is in the range of 1 to 3 μm; (2) the size f is necessary to be 1 μm or more; (3) the requirements relative to the molding ability and prevention of occurrence of cross talk phenomenon are fulfilled as long as the size g is in the range of 2 to 4 μm; (4) the size h is necessary to be in the range of 1 to 3 μm; (5) in view of efficiency in the laser processing using excimer laser, the sum (a+b) of the sizes a and b is necessary to be 20 μm or more; and (6) as the conditions for sufficiently crushing the rib, the size b is necessary to be larger than the sum (d+h) of the sizes d and h.

In consequence, it was found that a desirable ink jet recording head capable of stably and repeatedly providing a high quality record product can be obtained in the case where the following conditions are fulfilled:

$$1\ \mu m \leqq i \leqq 3\ \mu m$$

$$f \leqq 1\ \mu m$$

$$2\ \mu m \leqq g \leqq 4\ \mu m$$

$$1\ \mu m \leqq h \leqq 3\ \mu m$$

$$20\ \mu m \leqq (a+b) \leqq 60\ \mu m$$

$$(h+d) < b$$

The ink jet recording head according to the present invention can be employed in an appropriate printer.

Figure 8:
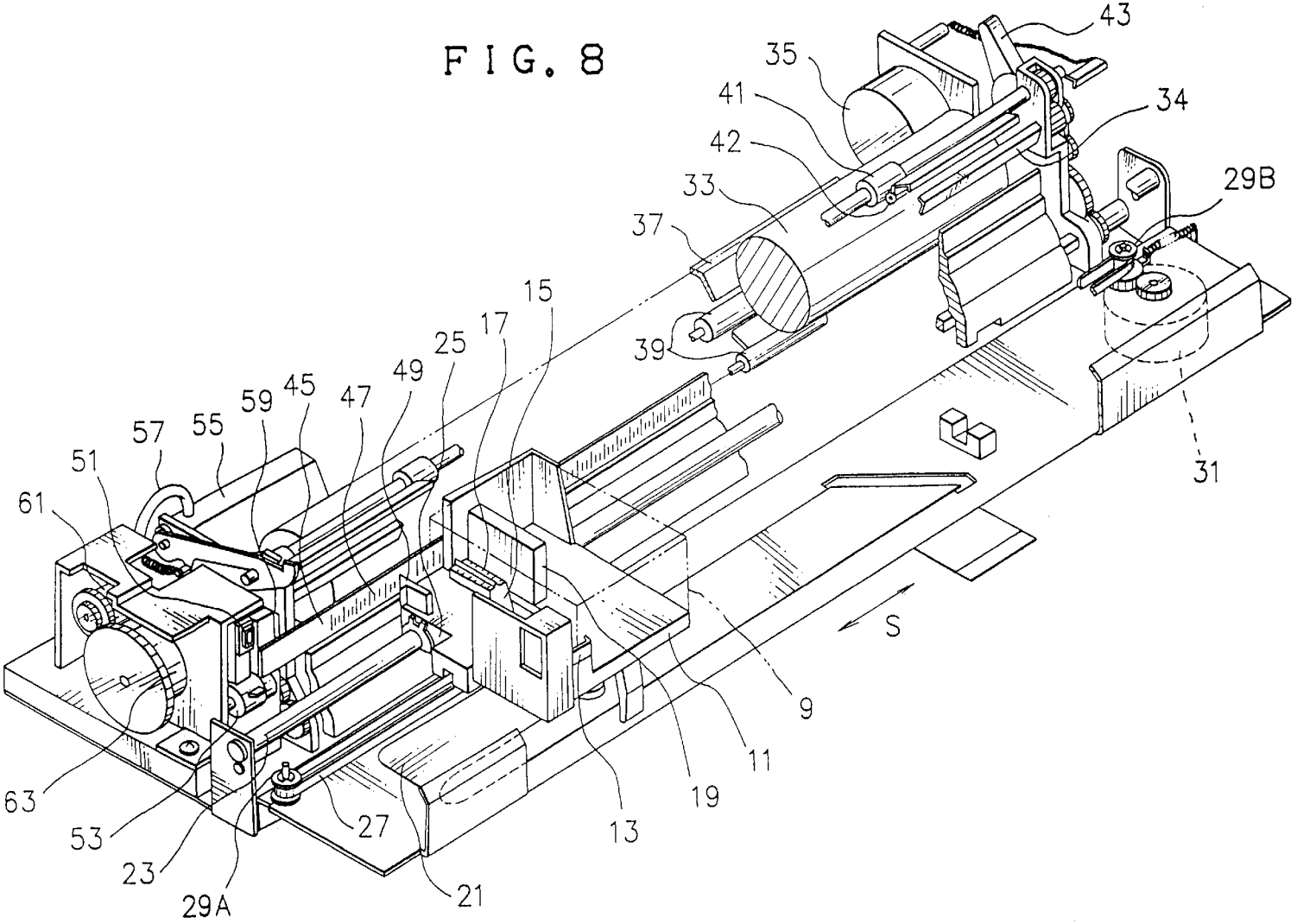
FIG. 8 is a schematic explanatory view illustrating an example of a printer in which the recording head of the present invention can be used.

As such printer, there can be mentioned a printer of the constitution shown in FIG. 8.

In FIG. 8, reference numeral 9 stands for a head cartridge of the configuration according to the present invention which is arranged on a carriage 11. The carriage 11 having said head cartridge 9 thereon is scanned in the direction indicated by arrow S. Reference numeral 13 stands for a hook for fixing the head cartridge 9 to the carriage 11. Reference numeral 15 stands for a lever for operating the hook 13. The lever 15 is provided with a marker 17 which enables to read the recording position or/and the setting position by the recording head of the head cartridge by directing the graduation formed at a cover which will be later described. Reference numeral 19 stands for a support member to hold an electric connection portion to the head cartridge 9. Reference numeral 21 stands for a flexible cable to connect the electric connection portion to the control system of the main body. Reference numeral 23 stands for a guide shaft for guiding the carriage 11 in the S direction and it is connected to bearing 25. Reference numeral 27 stands for a timing belt to which the carriage 11 is fixed and which serves to transmit a motive power in order to move the carriage 11. The timing belt 27 is tensely supported by a pair of belt pulleys 29A and 29B respectively arranged at opposite sides of the apparatus.

A driving force is transmitted to the belt pulley 29B from a carriage motor 31 through a transmission mechanism such as gear, etc. Reference numeral 33 stands for a conveying roller which serves to define the position to be recorded of a recording medium such as paper (hereinafter referred to as recording sheet) and which also serves to convey the recording sheet upon recording. The conveying roller 33 is driven by the action of a conveying motor 35.

Reference numeral 37 stands for a paper pan for guiding the recording sheet to the recording position from the side of a sheet feed tray. Reference numeral 39 stands for a feed roller arranged in the feeding path of the recording sheet. The feed roller 39 serves not only to urge the recording sheet against the conveying roller 33 but also to convey it. Reference numeral 34 stands for a platen arranged opposite to the ejection outlets of the head cartridge 9. The platen 34 serves to define the recording face of the recording sheet. Reference numeral 41 stands for a sheet discharging roller arranged in the upstream of the recording sheet conveying direction and in the downstream remote from the recording position. The discharging roller 41 serves to discharge the recording sheet toward the sheet discharging port. Reference numeral 42 stands for a gear wheel arranged to be corresponding to the sheet discharging roller 41. The gear wheel serves to urge the roller 41 through the recording sheet to cause a traveling force of the recording sheet by the sheet discharging roller. Reference numeral 43 stands for a release lever which serves to release the urging force of each of the feed roller 39, pressure plate 45 and gear wheel 42.

The pressure plate 45 serves not only to prevent the recording sheet from ascending in the vicinity of the recording position but also to assure the contact state to the conveying roller 33.

In this embodiment, as the recording head, there is employed the ink jet recording head capable of performing recording by ejecting ink. Therefore, the distance between the face provided with ink ejection outlets of the recording head and the face of the recording sheet on which record is to be done is relatively minute, and it is required to severely control said minute distance in order to prevent the recording sheet from contacting with the face provided with ink ejection outlets. For this purpose, use of the pressure plate 45 is effective. Reference numeral 47 stands for a graduation formed on the pressure plate 45. Reference numeral 49 stands for a marker disposed at the carriage so as to correspond to the graduation 47. These make it possible to perform readings of the printing position of the recording head and the setting position thereof. Reference numeral 51 stands for a cap made of an elastomer such as rubber. The cap 51 is disposed at the position opposite to the face provided with ink ejection outlets of the recording head in the home position and it is designed such that it can attach to or detach from the recording head. The cap 51 is used not only for protecting the recording head when it is not used but also at the time of carrying out recovery treatment of the ejection performance of the recording head. The ejection recovery treatment includes (i) provisional ejection treatment wherein the cap 51 is disposed opposite the face provided with ink ejection outlets and the ejection energy generating elements disposed inside the ink ejection outlets are actuated to thereby eject ink from all the ejection outlets, whereby removing foreign matters to hinder the ejecting performance of the ejection outlets such as gas bubble, dust, ink adhered, etc. and (ii) ejection recovery treatment wherein the face provided with ink ejection outlets is covered by the cap 51 and ink is forced to eject through the ink ejection outlets.

Reference numeral 53 stands for a pump which serves not only to provide a suction force in order to forcedly exhaust ink from the ejection outlets but also to aspirate the ink received in the cap 51 upon the ejection recovery treatment by such forced-exhaustion treatment or by the above provisional ejection recovery treatment. Reference numeral 55 stands for a container in which the ink aspirated by the pump 53 is to be stored. Reference numeral 57 stands for a tube to connect the pump 53 to the container 55.

Reference numeral 59 stands for a blade for wiping the face provided with ejection outlets of the recording head. The blade 59 is disposed such that it can move between the position which is projected toward the recording head side wherein wiping is performed during the period when the recording head is moving and the retreated position which is not in contact with the face provided with ejection outlets. Reference numeral 61 stands for a motor. Reference numeral 63 stands for a cam mechanism which serves to receive the transmittance of a motive force from the motor 61 thereby driving the pump 53 and moving the cap 51 or/and the blade 59.

The present invention provides marked effects in a recording head and a recording apparatus of the system in which ink is discharged utilizing thermal energy.

As for the representative constitution and the principle, it is desired to adopt such fundamental principle as disclosed, for example, in U.S. Pat. No. 4,723,129 or U.S. Pat. No. 4,740,796. While this system is capable of applying to either the so-called on-demand type or the continuous type, it is particularly effective in the case of the on-demand type because, by applying at least one driving signal for providing a rapid temperature rise exceeding nucleate boiling in response to recording information to an electrothermal converting body disposed for a sheet on which liquid (ink) is to be held or for a liquid pathway, the electrothermal converting body generates thermal energy to cause film boiling at ink on a heat acting face of the recording head and as a result, a gas bubble can be formed in the liquid (ink) in a one-by-one corresponding relationship to such driving signal. By way of growth and contraction of this gas bubble, the liquid (ink) is discharged through a discharging outlet to form at least one droplet. It is more desirable to make the driving signal to be of a pulse shape, since in this case, growth and contraction of a gas bubble take place instantly and because of this, there can be attained discharging of the liquid (ink) excelling particularly in responsibility. As the driving signal of pulse shape, such driving signal as disclosed in U.S. Pat. No. 4,463,359 or U.S. Pat. No. 4,345,262 is suitable. Additionally, in the case where those conditions disclosed in U.S. Pat. No. 4,313,124, which relates to the invention concerning the rate of temperature rise at the heat acting face, are adopted, further improved recording can be performed.

As for the constitution of the recording head, the present invention includes, other than those constitutions of the discharging outlets, liquid pathways and electrothermal converting bodies in combination (linear liquid flow pathway or perpendicular liquid flow pathway) which are disclosed in each of the above patent specifications, the constitutions using such constitution in which a heat acting portion is disposed in a curved region which is disclosed in U.S. Pat. No. 4,558,333 or U.S. Pat. No. 4,459,600. In addition, the present invention may effectively take a constitution based on the constitution in which a slit common to a plurality of electrothermal converting bodies is used as a discharging portion of the electrothermal converting bodies which is disclosed in Unexamined Japanese Patent Publication No. 123670/1984 or other constitution based on the constitution in which an opening for absorbing a pressure wave of thermal energy is made to be corresponding to a discharging portion which is disclosed in Unexamined Japanese Patent Publication No. 138461/1984.

Further, as the full-line type recording head having a length corresponding to the width of a maximum record medium which can be recorded by a recording apparatus, there can be employed either such constitution that the length is completed by such a combination of a plurality of recording heads as disclosed in the foregoing specifications or other constitution comprising a single recording head formed as an integrated structure, and in either case, the present invention provides the foregoing effects further effectively.

The present invention is effective also in the case where a recording head of the exchangeable chip type wherein electric connection to an apparatus body or supply of ink from the apparatus body is enabled when it is mounted on the apparatus body or other recording head of the cartridge type wherein an ink tank is integrally provided on the recording head itself is employed.

Further, it is desirable to add restoring means to a recording head or preparatory auxiliary means or the like as a constituent of the constitution of the recording apparatus according to the present invention in view of stabilizing the effects of the present invention. Specifically in this respect, capping means, cleaning means, pressurizing or attracting means, preliminary heating means including an electrothermal converting body or a separate heating element or a combination of these for the recording head, and to employ a preparatory discharging mode in which discharging is performed separately from recording, are also effective in order to achieve stable recording.

Furthermore, the present invention is extremely effective not only in a recording apparatus which has, as the recording mode, a recording mode of a main color such as black but also in an apparatus which includes a plurality of different colors or at least one of full-colors by color mixture, in which a recording head is integrally constituted or a plurality of recording heads are combined.

In the above-mentioned examples of the present invention, explanation was made with the use of liquid ink, but it is possible to use such ink that is in a solid state at room temperature or other ink that becomes to be in a softened state at room temperature in the present invention. In the foregoing ink jet apparatus, it is usual to adjust the temperature of ink itself in the range of 30° C. to 70° C. such that the viscosity of ink lies in the range capable of being stably discharged. In view of this, any ink can be used as long as it is in a liquid state upon the application of a use record signal. In addition, in the present invention, it is also possible to use those inks having a property of being liquefied, for the first time, with thermal energy, such as ink that can be liquefied and discharged in liquid state upon application of thermal energy depending upon a record signal or other ink that can start its solidification beforehand at the time of its arrival at a recording medium in order to prevent the temperature of the head from rising due to thermal energy by purposely using thermal energy as the energy for a state change of ink from solid state to liquid state or in order to prevent ink from being vaporized by solidifying the ink in a state of being allowed to stand. In the case of using these inks, it can be used in such manner as disclosed in Unexamined Japanese Patent Publication No. 56847/1979 or Japanese Unexamined Patent Publication No. 71260/1985 that such ink is maintained in concaved portions or penetrations of a porous sheet in a liquid state or in a solid state and the porous sheet is arranged to be such a configuration opposite to the electrothermal converting body. In the present invention, the most effective discharging system for each of the above-mentioned inks is the foregoing film-boiling system.

Further in addition, the ink jet recording apparatus of the present invention may take various configurations, for example, a configuration which is used as an image-outputting terminal in the information processing machines such as computer, a configuration comprising a copying apparatus combined with a reading machine, a configuration comprising a facsimile device provided with signal-sending and receiving functions, and the like.

TABLE 1

| top plate sample No. | size a (m) | size a (m) | size c (m) | size d (m) | size e (m) |
|---|---|---|---|---|---|
| 1 | 20 | 3 | 3 | 3 | 2 |
| 2 | 20 | 5 | 3 | 3 | 2 |
| 3 | 20 | 10 | 3 | 3 | 2 |
| 4 | 20 | 40 | 3 | 3 | 2 |

TABLE 1-continued

| | | | | | |
|---|---|---|---|---|---|
| 5 | 20 | 50 | 3 | 3 | 2 |
| 6 | 10 | 10 | 3 | 3 | 2 |
| 7 | 20 | 10 | 3 | 3 | 2 |
| 5 | 50 | 10 | 3 | 3 | 2 |
| 9 | 60 | 10 | 3 | 3 | 2 |
| 10 | 20 | 10 | 0 | 3 | 2 |
| 11 | 20 | 10 | 1 | 3 | 2 |
| 12 | 20 | 10 | 5 | 3 | 2 |
| 13 | 20 | 10 | 10 | 3 | 2 |
| 14 | 20 | 10 | 3 | 1 | 2 |
| 15 | 20 | 10 | 3 | 2 | 2 |
| 16 | 20 | 10 | 3 | 5 | 2 |
| 17 | 20 | 10 | 3 | 7 | 2 |
| 18 | 20 | 10 | 3 | 3 | 6 |
| 19 | 20 | 10 | 3 | 3 | 1 |
| 20 | 20 | 10 | 3 | 3 | 3 |
| 21 | 20 | 10 | 3 | 3 | 5 |
| comparative sample 1 | 20 | 0 | 0 | 0 | 0 |
| comparative sample 2 | 30 | 0 | 0 | 0 | 0 |
| comparative sample 3 | 40 | 0 | 0 | 0 | 0 |

| top plate sample No. | molding ability | easiness for orifice forming | occurrence of cross talk | total evaluation |
|---|---|---|---|---|
| 1 | ○ | ○ | X | X |
| 2 | ○ | ○ | Δ ~○ | Δ ~○ |
| 3 | ○ | ○ | ○ | ○ |
| 4 | ○ | Δ | ○ | Δ |
| 5 | ○ | X | — | X |
| 6 | X | X | — | X |
| 7 | ○ | ○ | ○ | ○ |
| 8 | ○ | Δ | ○ | Δ |
| 9 | X | X | — | X |
| 10 | ○ | ○ | X | X |
| 11 | ○ | ○ | ○ | ○ |
| 12 | ○ | ○ | ○ | ○ |
| 13 | X | ○ | X | X |
| 14 | X | X | — | X |
| 15 | ○ | ○ | ○ | ○ |
| 16 | ○ | ○ | ○ | ○ |
| 17 | X | ○ | X | X |
| 18 | ○ | ○ | Δ | Δ |
| 19 | ○ | ○ | ○ | ○ |
| 20 | ○ | ○ | ○ | ○ |
| 21 | X | ○ | X | X |
| comparison 1 | ○ | ○ | X | X |
| comparison 2 | ○ | ○ | X | X |
| comparison 3 | ○ | ○ | X | X |

TABLE 2

| ink jet recording head sample No. | size a (m) | size a (m) | size i (m) | size f (m) | size g (m) | size h (m) |
|---|---|---|---|---|---|---|
| 22 | 20 | 7 | 2 | 4 | 3 | 2 |
| 23 | 20 | 8 | 2 | 4 | 3 | 2 |
| 24 | 20 | 10 | 2 | 4 | 3 | 2 |
| 25 | 20 | 20 | 2 | 4 | 3 | 2 |
| 26 | 20 | 40 | 2 | 4 | 3 | 2 |
| 27 | 20 | 60 | 2 | 4 | 3 | 2 |
| 28 | 20 | 10 | 0 | 4 | 3 | 2 |
| 29 | 20 | 10 | 1 | 4 | 3 | 2 |
| 30 | 20 | 10 | 3 | 4 | 3 | 2 |
| 31 | 20 | 10 | 5 | 4 | 3 | 2 |
| 32 | 20 | 20 | 2 | 0 | 3 | 2 |
| 33 | 20 | 20 | 2 | 1 | 3 | 2 |
| 34 | 20 | 20 | 2 | 4 | 3 | 2 |
| 35 | 20 | 20 | 2 | 7 | 3 | 2 |
| 36 | 20 | 20 | 2 | 10 | 3 | 2 |
| 37 | 20 | 10 | 2 | 4 | 1 | 2 |
| 38 | 20 | 10 | 2 | 4 | 2 | 2 |
| 39 | 20 | 10 | 2 | 4 | 4 | 2 |
| 40 | 20 | 10 | 2 | 4 | 6 | 2 |
| 41 | 20 | 10 | 2 | 4 | 3 | 0 |
| 42 | 20 | 10 | 2 | 4 | 3 | 1 |
| 43 | 20 | 10 | 2 | 4 | 3 | 3 |

TABLE 2-continued

| | | | | | | |
|---|---|---|---|---|---|---|
| 44 | 20 | 10 | 2 | 4 | 3 | 5 |
| 45 | 5 | 10 | 2 | 4 | 3 | 2 |
| 46 | 10 | 10 | 2 | 4 | 3 | 2 |
| 47 | 50 | 10 | 2 | 4 | 3 | 2 |
| 48 | 70 | 10 | 2 | 4 | 3 | 2 |
| comparative sample 4 | 20 | 0 | 0 | 0 | 0 | 0 |
| comparative sample 5 | 40 | 0 | 0 | 0 | 0 | 0 |
| comparative sample 6 | 60 | 0 | 0 | 0 | 0 | 0 |

| ink jet recording head sample No. | molding ability | easiness for orifice forming | occurrence of cross talk | total evaluation |
|---|---|---|---|---|
| 22 | ○ | ○ | X | X |
| 23 | ○ | ○ | ○ | ○ |
| 24 | ○ | ○ | ○ | ○ |
| 25 | ○ | ○ | ○ | ○ |
| 26 | ○ | ○ | ○ | ○ |
| 27 | ○ | X | Δ | X |
| 28 | ○ | ○ | X | X |
| 29 | ○ | ○ | ○ | ○ |
| 30 | ○ | ○ | ○ | ○ |
| 31 | X | ○ | ○ | X |
| 32 | X | ○ | X | X |
| 33 | ○ | ○ | ○ | ○ |
| 34 | ○ | ○ | ○ | ○ |
| 35 | ○ | ○ | ○ | ○ |
| 36 | ○ | ○ | ○ | ○ |
| 37 | X | ○ | X | X |
| 38 | ○ | ○ | ○ | ○ |
| 39 | ○ | ○ | ○ | ○ |
| 40 | ○ | ○ | X | X |
| 41 | ○ | ○ | X | X |
| 42 | ○ | ○ | ○ | ○ |
| 43 | ○ | ○ | ○ | ○ |
| 44 | ○ | ○ | X | X |
| 45 | X | X | X | X |
| 46 | ○ | ○ | ○ | ○ |
| 47 | ○ | ○ | ○ | ○ |
| 48 | ○ | X | ○ | X |
| comparative sample 4 | ○ | ○ | X | X |
| comparative sample 5 | ○ | ○ | X | X |
| comparative sample 6 | ○ | ○ | X | X |

What we claim is:

1. An ink jet head comprising:

an ejection outlet member having a plurality of ejection outlets;

a plurality of energy generating elements for generating energy to be used for ejecting ink through said ejection outlets;

a plurality of ink pathways each communicated with each of said ejection outlets;

a liquid chamber communicated with said plurality of ink pathways;

a support member provided with said energy generating elements;

a grooved top plate having a plurality of grooves which define respective said ink pathways, each of said grooves having an axis of ink flow and a recess which defines said liquid chamber and the ejection outlet member provided with said ejection outlets; and a pressing means for press-contacting said support member and said grooved top plate, wherein said grooved top plate has a surface having said grooves on a side where the grooved top plate is contacted with said support member, said ejection outlet member has a jaw portion contacting a face of said support member on which said energy generating elements are provided while said jaw portion having a protruded portion which is protruded above said surface of said grooved top plate, said protruded portion being extended in a direction of crossing said axis of ink flow, and being contacted with said support member.

2. An ink jet recording head according to claim 1, wherein each of the energy generating elements generates a thermal energy in response to a recording signal, said thermal energy for causing a change in a state of ink to eject ink.

3. An ink jet head according to claim 1, wherein the protruded portion comprises a rib-shape protruded portion which is deformed by a press-force by the pressing means to close-contact with the support member.

4. An ink jet head according to claim 1, wherein the protruded portion of the jaw portion is entirely protruded above the surface of the grooved top plate, a rib is provided between the grooves of the grooved top plate such that said rib is extending in a direction along the axis of ink flow, and said rib is deformed by a press-force by the pressing means to close-contact with the support member.

5. An ink jet cartridge comprising:

an ink jet recording head, including:

an ejection outlet member having a plurality of ejection outlets;

a plurality of energy generating elements for generating energy to be utilized for ejecting the ink through said ejection outlets;

a plurality of ink pathways each communicated with each of said ejection outlets;

a liquid chamber communicated with said plurality of ink pathways;

a support member provided with said energy generating elements;

a grooved top plate having a plurality of grooves which define respective said ink pathways, each of said grooves having an axis of ink flow and a recess which defines said liquid chamber and the ejection outlet member provided with the ejection outlets; and a pressing means for press-contacting said support member and said grooved top plate, wherein said grooved top plate has a surface having said grooves on a side where the grooved top plate is contacted with said support member, said ejection outlet member has a jaw portion contacting a face of said support member on which said energy generating elements are provided while said jaw portion having a protruded portion which is protruded above said surface of said grooved top plate, said protruded portion being extended in a direction of crossing said axis of ink flow, and being contacted with said support member; and an ink container containing an ink to be supplied to said ink jet recording head, said ink jet recording head and said ink container being integrated.

6. An ink jet recording apparatus comprising:

an ink jet cartridge, and a control mechanism;

said ink jet cartridge being disposed on a holder, said ink jet cartridge including an ink jet recording head and an ink container containing ink to be supplied to said ink jet recording head, said ink jet recording head and said ink container being integrated, said control mechanism controlling a volume of said ink to be ejected from said ink jet cartridge while positioning said holder, said ink jet recording head including:

an ejection outlet member having a plurality of ejection outlets;

a plurality of energy generating elements for generating energy to be used for ejecting ink through said ejection outlets;

a plurality of ink pathways each communicated with each of said ejection outlets;

a liquid chamber communicated with said plurality of ink pathways;

a support member provided with said energy generating elements;

a grooved top plate having a plurality of grooves which define respective said ink pathways, each of said grooves having an axis of ink flow and a recess which defines said liquid chamber and the ejection outlet member having the ejection outlets; and a pressing means for press-contacting said support member and said grooved top plate, wherein said grooved top plate has a surface having said grooves on a side where the grooved top plate is contacted with said support member, said ejection outlet member has a jaw portion contacting a face of said support member on which said energy generating elements are provided while said jaw portion having a protruded portion which is protruded above said surface of said grooved top plate, said protruded portion being extended in a direction of crossing said axis of ink flow, and being contacted with said support member.

* * * * *

UNITED STATES PATENT AND TRADEMARK OFFICE

CERTIFICATE OF CORRECTION

PATENT NO. : 6,097,411

DATED : August 1, 2000

INVENTOR(S) : KUNIHIKO MAEOKA ET AL.

It is certified that error appears in the above-identified patent and that said Letters Patent is hereby corrected as shown below:

ON THE COVER PAGE:

Under Column [54], in the Title, "APPARATUS," should read --RECORDING HEAD,-.

COLUMN 1

Line 1, in the Title, "APPARATUS," should read --RECORDING HEAD,-.

COLUMN 2

Line 3, "a" should read --an--.

COLUMN 3

Line 56, "air existing" should read --air-existing--.

COLUMN 4

Line 45, "of the" (second occurrence) should be deleted.

COLUMN 9

Line 5, "the" (second occurrence) should be deleted.

COLUMN 12

Line 33, "result" should read --results--.

UNITED STATES PATENT AND TRADEMARK OFFICE

CERTIFICATE OF CORRECTION

PATENT NO. : 6,097,411

DATED : August 1, 2000

INVENTOR(S) : KUNIHIKO MAEOKA ET AL.

It is certified that error appears in the above-identified patent and that said Letters Patent is hereby corrected as shown below:

COLUMN 13

Line 51, "somewhat" should read --some--.

COLUMN 15

Line 3, "along" (second occurrence) should be deleted; and
Line 38, "what" should read --what is--.

Signed and Sealed this

Eighth Day of May, 2001

*Attest:*

Nicholas P. Godici

NICHOLAS P. GODICI

*Attesting Officer*

*Acting Director of the United States Patent and Trademark Office*